US011920209B2

(12) United States Patent
Nishioka et al.

(10) Patent No.: US 11,920,209 B2
(45) Date of Patent: Mar. 5, 2024

(54) CARBIDE-FREE BAINITE AND RETAINED AUSTENITE STEELS, PRODUCING METHOD AND APPLICATIONS OF SAME

(71) Applicant: NORTHWESTERN UNIVERSITY, Evanston, IL (US)

(72) Inventors: Kazuhiko Nishioka, Evanston, IL (US); Gregory B. Olson, Riverswood, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 91 days.

(21) Appl. No.: 16/969,318

(22) PCT Filed: Mar. 8, 2019

(86) PCT No.: PCT/US2019/021298
§ 371 (c)(1),
(2) Date: Aug. 12, 2020

(87) PCT Pub. No.: WO2019/173681
PCT Pub. Date: Sep. 12, 2019

(65) Prior Publication Data

US 2021/0047705 A1 Feb. 18, 2021

Related U.S. Application Data

(60) Provisional application No. 62/640,096, filed on Mar. 8, 2018.

(51) Int. Cl.
*C21D 9/46* (2006.01)
*C21D 1/19* (2006.01)
(Continued)

(52) U.S. Cl.
CPC ..... *C21D 9/46* (2013.01); *C21D 1/19* (2013.01); *C21D 1/84* (2013.01); *C21D 6/005* (2013.01);
(Continued)

(58) Field of Classification Search
CPC ... C21D 9/46; C21D 1/19; C21D 1/84; C21D 6/005; C21D 6/008; C21D 8/0205;
(Continued)

(56) References Cited

U.S. PATENT DOCUMENTS 8,956,470 B2 2/2015 Bhadeshia et al.
2006/0011274 A1 1/2006 Speer et al.
(Continued)

FOREIGN PATENT DOCUMENTS

CN 102628144 A * 8/2012
JP H0559429 A * 3/1993 ..... C21D 6/00
(Continued)

OTHER PUBLICATIONS

JPH0559429A english translation (Year: 1993).*
(Continued)

*Primary Examiner* — Ricardo D Morales
(74) *Attorney, Agent, or Firm* — Locke Lord LLP; Tim Tingkang Xia, Esq.

(57) ABSTRACT

One aspect, this invention relates to a carbide-free bainite and retained austenite steel including a composition designed and processed such that the carbide-free bainite and retained austenite steel meets property objectives comprising a yield strength in a range of about 1000-2000 MPa, a uniform ductility, a desired total elongation and hole-expansion ratio, a desired level of weldability and an austenite stability designed to have an austenite start temperature $M_s^o$ to be equal to an application temperature in range from about 50° C. to −50° C. The property objectives are
(Continued)

design specifications of the carbide-free bainite and retained austenite steel.

4 Claims, 31 Drawing Sheets

(51) Int. Cl.

| | |
|---|---|
| ***C21D 1/84*** | (2006.01) |
| ***C21D 6/00*** | (2006.01) |
| ***C21D 8/02*** | (2006.01) |
| ***C22C 38/02*** | (2006.01) |
| ***C22C 38/04*** | (2006.01) |
| ***C22C 38/12*** | (2006.01) |

(52) U.S. Cl.
CPC ..... *C21D 6/008* (2013.01); *C21D 8/0205* (2013.01); *C21D 8/0226* (2013.01); *C21D 8/0236* (2013.01); *C21D 8/0263* (2013.01); *C22C 38/02* (2013.01); *C22C 38/04* (2013.01); *C22C 38/12* (2013.01); *C21D 2211/001* (2013.01); *C21D 2211/002* (2013.01)

(58) Field of Classification Search
CPC .. C21D 8/0226; C21D 8/0236; C21D 8/0263; C21D 2211/001; C21D 2211/002; C22C 38/02; C22C 38/04; C22C 38/12
See application file for complete search history.

(56) References Cited

U.S. PATENT DOCUMENTS

| | | | |
|---|---|---|---|
| 2010/0247368 A1 | 9/2010 | Rawson et al. | |
| 2013/0192726 A1* | 8/2013 | Chen ..... | C22C 38/22 148/333 |

FOREIGN PATENT DOCUMENTS

| | | | |
|---|---|---|---|
| JP | H05320749 | A | 12/1993 |
| JP | 4664475 | B2 | 4/2011 |
| JP | 2013545890 | A | 12/2013 |
| KR | 20150130612 | A | 11/2015 |
| KR | 20170120180 | A | 10/2017 |

OTHER PUBLICATIONS

Korean Intellectual Property Office (ISR/KR), "International Search Report for PCT/US2019/021298", Korea, dated Jun. 19, 2019.
Koh ichi Sugimoto, Masahiro Misu, Mitsuyuki Kobayashi, and Hidenori Shirasawa. Effects of second phase morphology on retained austenite morphology and tensile properties in a trip-aided dual-phase steel sheet. ISIJ International, 33(7):775-782, 1993.
Koh ichi Sugimoto, Akinobu Kanda, Ryo Kikuchi, Shun ichi Hashimoto, Takahiro Kashima, and Shushi Ikeda. Ductility and formability of newly developed high strength low alloy trip-aided sheet steels with annealed martensite matrix. ISIJ International, 42(8):910-915, 2002.
S. Zhang and K.O. Findley. Quantitative assessment of the effects of microstructure on the stability of retained austenite in trip steels. Acta Materialia, 61(6):1895-1903, 2013.
Trine Nybo Lomholt, Y. Adachi, Alice Bastos da Silva Fanta, Karen Pantleon, and Marcel A. J. Somers. Partial transformation of austenite in al-mn-si trip steel upon tensile straining: an in situ ebsd study. Materials Science and Technology, 29(11):1383-1388, 2013.
G.N. Haidemenopoulos and A.N. Vasilakos. On the thermodynamic stability of retained austenite in 4340 steel. Journal of Alloys and Compounds, 247(1):128-133, 1997.
Haidemenopoulos Gregory N., Katsamas Antonis I., and Aravas Nikolaos. Stability and constitutive modelling in multiphase trip steels. steel research international, 77(9-10):720-726, 2006.
M. L. Brandt. Bainitic Stabilization of Austenite in Low Alloy Sheet Steels. PhD thesis, Northwestern University, 1997.
J. Gong. Predictive Process Optimization for Fracture Ductility in Automotive TRIP Steels. PhD thesis, Northwestern University, 2013.
A. Behera. Non-Equilibrium Thermodynamics of Quench and Partition (Q&P) Steels. PhD thesis, Northwestern University, 2018.
G. B. Olson and Morris Cohen. A general mechanism of martensitic nucleation: Part 1. general concepts and the fcc to hcp transformation. Metallurgical Transactions A, 7(12):1897-1904, Dec. 1976.
G. B. Olson and Morris Cohen. Stress-assisted isothermal martensitic transformation: Application to trip steels. Metallurgical Transactions A, 13(11):1907-1914, Nov. 1982.
G. B. Olson and Morris Cohen. Kinetics of strain-induced martensitic nucleation. Metallurgical Transactions A, 6(4):791, Apr. 1975.
T. Narutani, G. B. Olson, and M. Cohen. Constitutive flow relations for austenitic steels during strain-induced martensitic transformation. In Journal de Physique (Paris), Colloque, vol. 43, 12 1982.
R.G. Stringfellow, D.M. Parks, and G.B. Olson. A constitutive model for transformation plasticity accompanying strain-induced martensitic transformations in metastable austenitic steels. Acta Metallurgica et Materialia, 40(7):1703-1716, 1992.
J.R. Patel and M. Cohen. Criterion for the action of applied stress in the martensitic transformation. Acta Metallurgica, 1(5):531-538, 1953.
G. B. Olson, K. Tsuzaki, and Morris Cohen. Statistical aspects of martensitic nucleation. MRS Proceedings, 57:129, 1985.
Xinping Chen, Haoming Jiang, Zhenxiang Cui, Changwei Lian, and Chao Lu. Hole expansion characteristics of ultra high strength steels. Procedia Engineering, 81:718-723, 2014. 11th International Conference on Technology of Plasticity, ICTP 2014, Oct. 19-24, 2014, Nagoya Congress Center, Nagoya, Japan.
C. S. Smith. A Search for Structure. American Association of Physics Teachers, 1981.
G. B. Olson. Computational design of hierarchically structured materials. Science, 277(5330):1237-1242, 1997.
Gregory B. Olson. Designing a new material world. Science, 288(5468):993-998, 2000.
R. H. Richman and G. F. Bolling. Stress, deformation, and martensitic transformation. Metallurgical Transactions, 2 (9):2451-2462, Sep. 1971.
C. Garcia-Mateo, F. G. Caballero, and H. K. D. H. Bhadeshia. Development of hard bainite. ISIJ International, 43(8):1238-1243, 2003.
Yoshiyuki Tomita, Takeyoshi Okawa, Effect of microstructure on mechanical properties of isothermally bainite-transformed 300M steel, Materials Science and Engineering: A, vol. 172, Issues 1-2, 1993.
F.D. Fischer, G. Reisner, E. Werner, K. Tanaka, G. Cailletaud, T. Antretter, A new view on transformation induced plasticity (TRIP), International Journal of Plasticity, vol. 16, Issues 7-8, 2000.
F. G. Caballero, H. K. D. H. Bhadeshia, K. J. A. Mawella, D. G. Jones & P. Brown, Very strong low temperature bainite, Materials Science and Technology, vol. 18, Issue 3, 2002.
Yuki Toji, Goro Miyamoto, DierkRaabe, Carbon partitioning during quenching and partitioning heat treatment accompanied by carbide precipitation, ActaMaterialia, vol. 86, 2015.
Roja Modaresi, Stefan Pauliuk, Amund N. LÃyvik, and Daniel B. MÃijller. Global carbon benefits of material substitution in passenger cars until 2050 and the impact on the steel and aluminum industries. Environmental Science & Technology, 48(18):10776-10784, 2014. PMID: 25111289.
S. Keeler and M. Kimchi. Advanced high-strength steels application guidlines version 5.0. WorldAutoSteel, 2014.
C. M. Tamarelli. The evolving use of advanced high-strength steels for automotive applications. Steel martket Dev. Institute, Autosteel, 2011.
E. D. Moor D. K. Matlock, J. G. Speer and P. J. Gibbs. Recent developments in advanced high strength sheet steels for automotive applications: an overview. Jestech, 15(7):1-12, 2012.
D. Bhandarkar, V. F. Zackay, and E. R. Parker. Stability and mechanical properties of some metastable austenitic steels. Metallurgical Transactions, 3(10):2619-2631, Oct. 1972.

(56) References Cited

OTHER PUBLICATIONS

Li Wang and John G. Speer. Quenching and partitioning steel heat treatment. Metallography, Microstructure, and Analysis, 2(4):268-281, Aug. 2013.
H. K. D. H. Bhadeshia. Nanostructured bainite. Proceedings of the Royal Society of London A: Mathematical, Physical and Engineering Sciences, 466(2113):3-18, 2010.
Carlos Garcia-Mateo, Georg Paul, Mahesh C Somani, David A Porter, Lieven Bracke, Andreas Latz, Carlos Garcia De Andres, and Francisca G Caballero. Transferring Nanoscale Bainite Concept to Lower C Contents : A Perspective. Metals, 7(159), 2017.
G. B. Olson and M. Cohen. Dislocation Theory of Martensitic Transformations, vol. 7, pp. 295-407. North-Holland, 1986.
G. Ghosh and G.B. Olson. Kinetics of f.c.c. to b.c.c. heterogeneous martensitic nucleation—1. the critical driving force for athermal nucleation. Acta Metallurgica et Materialia, 42(10):3361-3370, 1994.
G. Ghosh and G.B. Olson. Kinetics of f.c.c. to b.c.c. heterogeneous martensitic nucleation—2. thermal activation. Acta Metallurgica et Materialia, 42(10):3371-3379, 1994.
G. Ghosh and G.B. Olson. Computational thermodynamics and the kinetics of martensitic transformation. Journal of Phase Equilibria, 22(3):199-207, 2000.
G.B. Olson, H.K.D.H. Bhadeshia, and M. Cohen. Coupled diffusional/displacive transformations. Acta Metallurgica, 37(2):381-390, 1989.
G. B. Olson, H.K.D.H. Bhadeshia, and M. Cohen. Coupled diffusional/displacive transformations: Part II. Solute trapping. Metallurgical Transactions A, 21(3):805-809, 1990.
Y. Mizutani. Coupled gamma / alpha phase transformations in low carbon steels. PhD thesis, Northwestern University, 2006.
M. J. Aziz. Model for solute redistribution during rapid solidification. Appl. Phys. Lett., 53(1158), 1982.
M. J. Aziz. Dissipation-theory treatment of the transition from diffusionaâ€□controlled to diffusionless solidification. Appl. Phys. Lett., 43(552), 1983.
L. M. Goldman and M. J. Aziz. Aperiodic stepwise growth model for the velocity and orientation dependence of solute trapping. Journal of Materials Research, 2(4):524-527, 1987.
V. F. Zackay, E. R. Parker, D. Fahr, and R. Busch. The enhancement of ductility in high strength steels. Trans. ASM, 60:252-259, 1967.
G. B. Olson and M. Azrin. Transformation behavior of trip steels. Metallurgical Transactions A, 9(5):713-721, May 1978.
E. Pereloma, A. Gazder, and I. Timokhina. Retained austenite: transformation-induced plasticity. Encyclopedia of Iron, Steel, and Their Alloys, pp. 3088-3103, 2016.
Jiajun Wang and Sybrand Van Der Zwaag. Stabilization mechanisms of retained austenite in transformation-induced plasticity steel. Metallurgical and Materials Transactions A, 32(6):1527-1539, Jun. 2001.
R. BlondÃ@, E. Jimenez-Melero, L. Zhao, J. P. Wright, E. BrÃ1/4ck, S. Van Der Zwaag, and N. H. Van Dijk. High-energy x-ray diffraction study on the temperature-dependent mechanical stability of retained austenite in low-alloyed trip steels. Acta Materialia, 60(2):565-577, Jan. 2012.
E. Jimenez-Melero, N.H. van Dijk, L. Zhao, J. Sietsma, S.E. Offerman, J.P. Wright, and S. van der Zwaag. Characterization of individual retained austenite grains and their stability in low-alloyed trip steels. Acta Materialia, 55(20):6713-6723, 2007.
Xianming Zhao, Yongfeng Shen, Lina Qiu, Yandong Liu, Xin Sun, and Liang Zuo. Effects of intercritical annealing temperature on mechanical properties of fe-7.9mn-0.14si-0.05al-0.07c steel. In Materials, 2014.

* cited by examiner

C&P treatment

Super Nainite treatment

CFB treatment

Q&P treatment

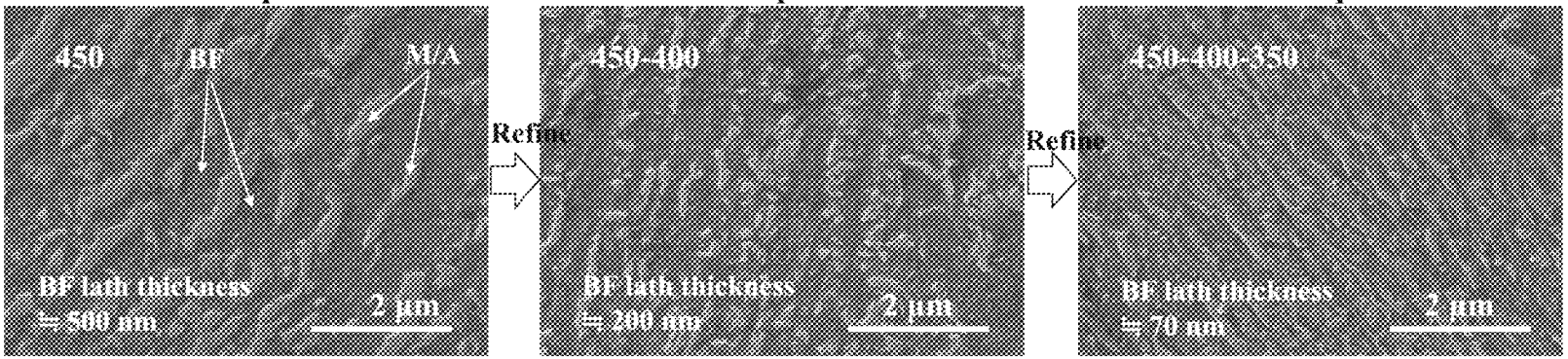
FIG. 10A
FIG. 10B
FIG. 10C
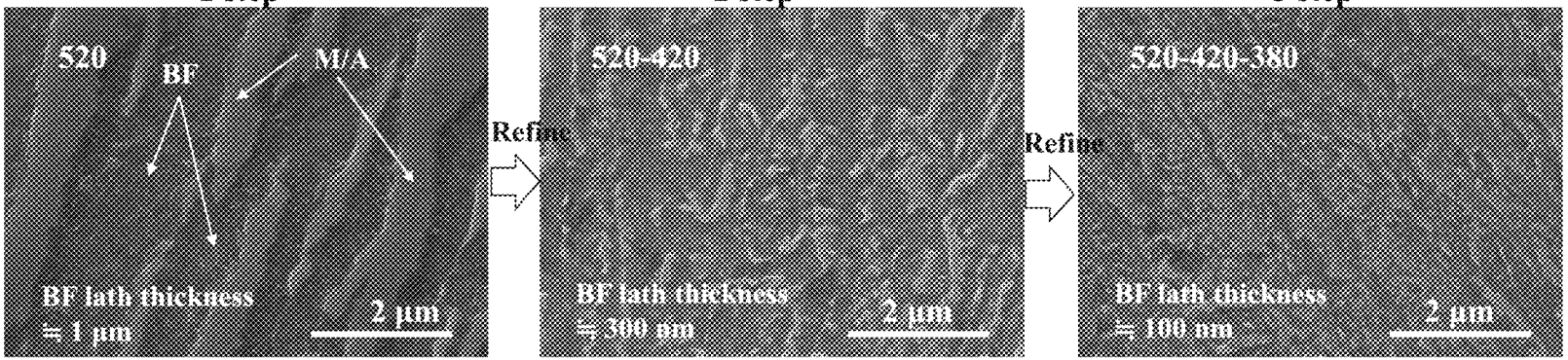
FIG. 10D
FIG. 10E
FIG. 10F

IPF Map

Phase Map

Carbon Concentration in Austenite

Volume Fraction of Austenite

Measured Bs temperature

Measured Ms temperature

Isothermal transformation at 520 °C

After Calibration

Before Calibration

Relationship between Partition Temperature and Plate Thickness

CARBIDE-FREE BAINITE AND RETAINED AUSTENITE STEELS, PRODUCING METHOD AND APPLICATIONS OF SAME

CROSS-REFERENCE TO RELATED PATENT APPLICATION

This application claims priority to and the benefit of, pursuant to 35 U.S.C. § 119(e), of U.S. Provisional Patent Application Ser. No. 62/640,096, filed Mar. 8, 2018, entitled "METHOD FOR PRODUCING CARBIDE-FREE BAINITE AND RETAINED AUSTENITE STEELS BY OPTIMIZED COOLING," by Kazuhiko Nishioka and Gregory B. Olson, which is incorporated herein by reference in its entirety.

Some references, which may include patents, patent applications and various publications, are cited in a reference list and discussed in the description of this invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference. In terms of notation, hereinafter, "[n]" represents the nth reference cited in the reference list. For example, [23] represents the 23th reference cited in the reference list, namely, Nicholas J. Wengrenovich and Gregory B. Olson. Optimization of a TRIP steel for adiabatic fragment protection. *Materials Today: Proceedings, S*2:S639-S642, 2015.

STATEMENT AS TO RIGHTS UNDER FEDERALLY-SPONSORED RESEARCH

This invention was made with government support under 70NANB14H012 awarded by the National Institute of Standards and Technology. The government has certain rights in the invention.

FIELD OF THE INVENTION

The invention relates generally to materials, and more particularly, to carbide-free bainite and retained austenite steels, producing method and applications of the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

Automotive manufacturing is one of the major global industries which drives innovation and research in the field of structural materials. Automotive is primarily constituted by iron based alloys, copper, zinc, aluminum, magnesium, titanium alloys and engineered polymer composites. Ferrous metals and alloys are the most utilized ones among those materials, representing 67% by weight. There has been strong motivations and continuous improvements on fuel efficiency and driver safety of the automobiles, which have been enabled by improved structural materials as well as improved structure and design. These improvements ensure product reliability and increase affordability, resulting in the development of a wide range of material solutions for automotive applications. Some of the solutions incorporated developing newer lightweight materials with sufficient strength, utilization of downgauging, product design optimization etc. Steels are one of the most used materials in the car body and the type of steel used depends on the specific part of the car body. High strength with minimal deformation during crash is required for maximizing passenger safety while excellent stretch formability or ductility is required for deep drawing of the parts. A combination of both is required for components that are needed for energy absorption, durability and load bearing strength of the car.

Therefore, a heretofore unaddressed need exists in the art to address the aforementioned deficiencies and inadequacies.

SUMMARY OF THE INVENTION

In one aspect, the invention relates to a carbide-free bainite and retained austenite steel. In one embodiment, the carbide-free bainite and retained austenite steel includes a composition designed and processed such that the carbide-free bainite and retained austenite steel meets property objectives comprising a yield strength in a range of about 1000-2000 MPa, a uniform ductility, a desired total elongation and hole-expansion ratio, a desired level of weldability and an austenite stability designed to have an austenite start temperature $M_s^o$ to be equal to an application temperature in range from about 50° C. to −50° C. The property objectives are design specifications of the carbide-free bainite and retained austenite steel.

In one embodiment, the application temperature is about 5° C., or about −20° C.

In one embodiment, the composition is processed with a cooling and partitioning treatment.

In one embodiment, the composition comprises carbon (C) no more than 0.4 wt %, silicon (Si) no less than 1.0 wt %, and iron (Fe) in balance.

In one embodiment, the composition further comprises manganese (Mn) in a range of about 0.2-1.0 wt. %, and molybdenum (Mo) in a range of about 0.4-0.8 wt. %.

In one embodiment, the composition further comprises manganese (Mn) in a range of about 0.2-1.0 wt. %, and chromium (Cr) in a range of about 0.1-0.9 wt. %.

In one embodiment, the property objectives further comprises a carbon concentration in austenite, $C_\gamma$, in a range of about 1.0-1.8 wt %.

In another aspect, the invention relates to a method for producing a carbide-free bainite and retained austenite steel. In one embodiment, the method includes providing an iron (Fe) alloy containing a composition designed according to property objectives of the carbide-free bainite and retained austenite steel, wherein the property objectives are design specifications of the carbide-free bainite and retained austenite steel; and heat-treating the alloy to a temperature above $A_{c3}$, where $A_{c3}$ is a temperature at which a transformation from ferrite into austenite is finished; succeeding quenching the heat-treated alloy to a bainite region at a temperature between $M_s$ and $B_s$, wherein $M_s$ is a temperature at which a martensitic transformation starts in the alloy, and $B_s$ is a temperature at which a coupled diffusional/displacive bainitic transformation starts the alloy; and optimally cooling the quenched alloy to form to form the carbide-free bainite and retained austenite steel that meets the property objectives, wherein a cooling ratio of the optimally cooling step is precisely controlled so that the temperature of the alloy continues to be slightly above the $M_s$ temperature which keeps decreasing during the optimally cooling step.

In one embodiment, the heat-treating step is performed with an austenization or hot rolling treatment.

In one embodiment, the heat-treating step is performed with a hot rolling treatment and subsequently a cold rolling treatment and a solution treatment.

In one embodiment, the optimally cooling step is performed with gradually cooling or step-wise cooling.

In one embodiment, the property objectives comprises a yield strength in a range of about 1000-2000 MPa, a uniform ductility, a desired total elongation and hole-expansion ratio, a desired level of weldability and an austenite stability designed to have an austenite start temperature $M_s^{\sigma}$ to be equal to an application temperature in range from about 50° C. to −50° C.

In one embodiment, the composition comprises carbon (C) no more than 0.4 wt %, silicon (Si) no less than 1.0 wt %, and iron (Fe) in balance.

In one embodiment, the composition further comprises manganese (Mn) in a range of about 0.2-1.0 wt. %, and molybdenum (Mo) in a range of about 0.4-0.8 wt. %.

In one embodiment, the composition further comprises manganese (Mn) in a range of about 0.2-1.0 wt. %, and chromium (Cr) in a range of about 0.1-0.9 wt. %.

In yet another aspect, the invention relates to a method for designing a carbide-free bainite and retained austenite steel. In one embodiment, the method includes defining property objectives of the carbide-free bainite and retained austenite steel, wherein the property objectives are design specifications of the carbide-free bainite and retained austenite steel; designing a composition of the carbide-free bainite and retained austenite steel according to the property objectives; and processing the composition to form the carbide-free bainite and retained austenite steel that meets the property objectives, wherein the processing step is performed with a cooling and partitioning process.

In one embodiment, the processing step comprises solidifying the composition to form an alloy; and reheating the alloy.

In one embodiment, the cooling and partitioning process comprises heat-treating the alloy to a temperature above $A_{c3}$, where $A_{c3}$ is a temperature at which a transformation from ferrite into austenite is finished; succeeding quenching the heat-treated alloy to a bainite region at a temperature between $M_s$ and $B_s$, wherein $M_s$ is a temperature at which a martensitic transformation starts in the alloy, and $B_s$ is a temperature at which a coupled diffusional/displacive bainitic transformation starts the alloy; and optimally cooling the quenched alloy to form to form the carbide-free bainite and retained austenite steel that meets the property objectives, wherein a cooling ratio of the optimally cooling step is precisely controlled so that the temperature of the alloy continues to be slightly above the $M_s$ temperature which keeps decreasing during the optimally cooling step.

In one embodiment, the heat-treating step is performed with an austenization or hot rolling treatment.

In one embodiment, the heat-treating step is performed with a hot rolling treatment and subsequently a cold rolling treatment and a solution treatment.

In one embodiment, the optimally cooling step is performed with gradually cooling or step-wise cooling.

In one embodiment, the property objectives comprises a yield strength in a range of about 1000-2000 MPa, a uniform ductility, a desired total elongation and hole-expansion ratio, a desired level of weldability and an austenite stability designed to have an austenite start temperature $M_s^{\sigma}$ to be equal to an application temperature in range from about 50° C. to −50° C.

In one embodiment, the composition comprises carbon (C) no more than 0.4 wt %, silicon (Si) no less than 1.0 wt %, and iron (Fe) in balance.

In a further aspect, the invention relates to a method for designing a carbide-free bainite and retained austenite steel. In one embodiment, the method includes determining a composition, and producing a trial alloy from the trial composition, wherein the trial alloy has substantially high hardenability to avoid formation of ferrite, and contains carbon no more than 0.4 wt % for weldability and silicon no less than 1.0 wt % for carbide prohibition; performing a cooling and partitioning treatment to the trial alloy, and experimentally evaluating the trial alloy at an initial state, a transitional path, and an end state of the cooling and partitioning treatment to obtain trial parameters comprising at least a quenching temperature, a descent of a $M_s$ temperature, and a final partitioning temperature; refining the composition by computational material engineering models using the trial parameters, such that an alloy formed of the refined composition meets property objectives of the carbide-free bainite and retained austenite steel, wherein the property objectives are design specifications of the carbide-free bainite and retained austenite steel.

In one embodiment, at the initial state, $M_s$ temperature, $B_s$ temperature used to identify a quenching temperature, and a bainite start time at different temperatures are measured; at the transitional path, the $M_s$ temperature is measured at different process times so as to determine a descent of the $M_s$ temperature; and at the end state, a final partitioning temperature, mechanical performance, austenite stability, and microstructures are measured.

In one embodiment, the cooling and partitioning treatment comprises heat-treating the alloy to a temperature above $A_{c3}$, where $A_{c3}$ is a temperature at which a transformation from ferrite into austenite is finished; succeeding quenching the heat-treated alloy to a bainite region at a temperature between $M_s$ and $B_s$, wherein $M_s$ is a temperature at which a martensitic transformation starts in the alloy, and $B_s$ is a temperature at which a coupled diffusional/displacive bainitic transformation starts the alloy; and optimally cooling the quenched alloy to form to form the carbide-free bainite and retained austenite steel that meets the property objectives, wherein a cooling ratio of the optimally cooling step is precisely controlled so that the temperature of the alloy continues to be slightly above the $M_s$ temperature which keeps decreasing during the optimally cooling step.

In one embodiment, the optimally cooling step is performed with gradually cooling or step-wise cooling.

In one embodiment, the property objectives comprises a yield strength in a range of about 1000-2000 MPa, a uniform ductility, a desired total elongation and hole-expansion ratio, a desired level of weldability and an austenite stability designed to have an austenite start temperature $M_s^{\sigma}$ to be equal to an application temperature in range from about 50° C. to −50° C.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The following drawings form part of the present specification and are included to further demonstrate certain aspects of the invention. The invention may be better understood by reference to one or more of these drawings in combination with the detailed description of specific embodiments presented herein. The drawings described below are for illustration purposes only. The drawings are not intended to limit the scope of the present teachings in any way.

FIGS. 10A-10F are SEM images of samples after the C&P treatment; (FIG. 10A) sample 450, (FIG. 10B) sample 450-400, (FIG. 10C) sample 450-400-350, (FIG. 10D) sample 520, (FIG. 10E) sample 520-420 and (FIG. 10F) sample 520-420-380, according to embodiments of the invention.

(FIG. 11A) phase map with unindexed regions in black color, and (FIG. 11B) inverse color map, according to embodiments of the invention.

(FIG. 13A) carbon concentration in austenite, and (FIG. 13B) volume fraction of austenite, according to embodiments of the invention.

(FIG. 15A) determination of $B_s$ temperature by slow cooling, (FIG. 15B) determination of $M_s$ temperature by fast quenching, and (FIG. 15C) determination of bainitic kinetics by isothermal transformation at 520 C, according to embodiments of the invention.

DETAILED DESCRIPTION OF THE INVENTION

Figure 1A:
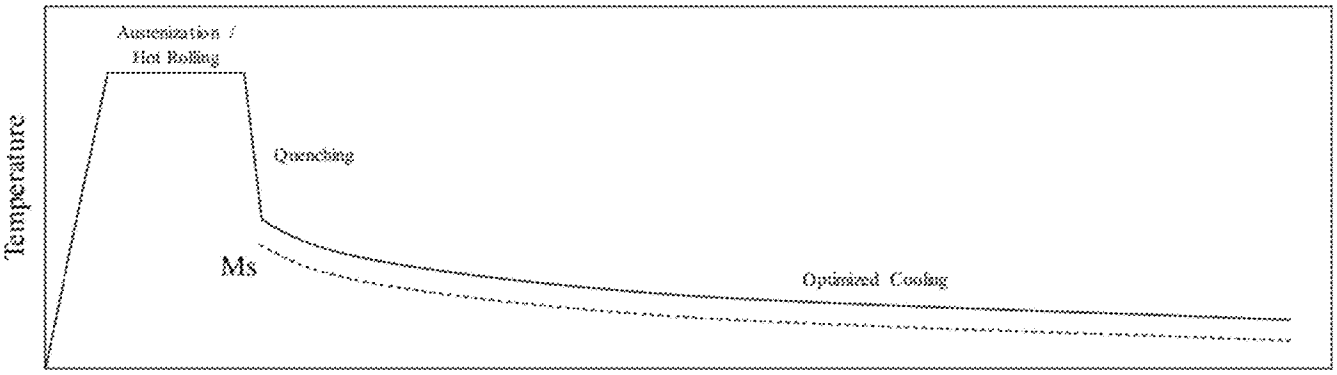
FIGS. 1A-1D illustrate comparisons between heat-treatments for a cooling and partitioning (C&P) process (FIG. 1A) according to one embodiment of the invention and conventional super bainite (FIG. 1B), quenching and partitioning (Q&P) (FIG. 1C) and carbide free bainitic (CFB) (FIG. 1D) processes.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms.

The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that, as used in the description herein and throughout the claims that follow, the meaning of "a", "an", and "the" includes plural reference unless the context clearly dictates otherwise. Also, it will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

As used in this disclosure, the term "advanced high strength steels", or its acronym "AHSS", refers to a new category of steels that has remarkable mechanical properties including very high tensile strength along with a considerable amount of ductility. The development of AHSS can be categorized into three generations. The first generation of AHSS is low alloyed steels with good combination of tensile strength and total elongation. These steels include the widely used dual phase (DP) steels, high strength low alloy (HSLA) steels, transformation induced plasticity (TRIP) steels and others. The second generation of austenitic AHSS demonstrates remarkably high strength values along with significant high elongation standards. These steels include the fully austenitic TRIP steels as well as the twinning induced plasticity (TWIP) steels which has a considerable amount of alloying additions (12%-30% Mn) that makes the steel too expensive for practical applications along with issues of mass production and weldability. The third generation comprises the carbide free bainitic (CFB) steels, medium manganese steels (5-10 wt %) and the quenched and partitioned (Q&P) steels. These steels are more feasible for industrial applications and have been commercialized in some cases by industrial manufacturers.

Thermomechanical processing of AHSS grades is crucial in generating the requisite microstructure that results in the desired mechanical properties. Most of the processing cycles start with a starting austenitization (full or partial) step and then cooling to different temperature regimes. The wide number of microstructural phases in iron-based alloys makes it possible for an array of resulting microstructures depending on the cooling rate. Subsequent heat treatment after the cooling step could vary from isothermal annealing at a fixed temperature to interrupted quenching and isothermal annealing at higher temperature depending on the desired microstructure. The microstructure after thermomechanical processing can constitute a mixture of the following phases: ferrite, bainite, retained austenite, martensite, carbides. The final steel properties are dependent on the composition, phase fraction and distribution of these phases in the microstructure.

AHSS are specifically developed to use as structural members in automotive applications. Some of the key attributes of AHSS in this regard include high strength, enhanced ductility, formability and weldability. Formability is defined as the ability of a material to be formed into simple and complex shapes by deformation processes. It is measured by using a variety of tests such as uniaxial tension tests, hemispherical punch forming, deep drawing and hole expansion tests. Welding is essential when constructing any structure. There has been strong demand from automotive industry for the materials which satisfy all these features at the same time.

As used in this disclosure, the term "quenched and partitioned steels", or its acronym "Q&P steels", refers to steels produced by a heat treatment with a quenching and partitioning (Q&P) process, which is a multi-step heat treatment that results in a composite microstructure of martensite, bainite, austenite and in some cases ferrite. These steels present good mechanical properties in term of strength, ductility and fracture toughness, all of which are essential properties for automotive applications. The Q&P process is schematically presented in FIG. 1C. The steel is first heat-treated in the single phase austenite range at temperature $T>A_{c3}$ or intercritical range at $A_{c1}<T<A_{c3}$, in order to transform the microstructure into fully or partially austenite, where the $A_{c1}$ temperature is a start temperature for the transformation from pearlite into austenite, and the $A_{c3}$ temperature is a finish temperature for the transformation from ferrite into austenite, then is rapidly quenched to a temperature between $M_s$ (martensite start) and $M_f$ (martensite finish) temperatures to transform an optimal amount of austenite to martensite, which is the quenching step. The steel is then isothermally held for a certain amount of time (the partitioning step) at a higher temperature than a quenching temperature in order to allow the diffusion of carbon from the martensite laths to the retained austenite. Doing so will enrich the austenite in carbon, therefore stabilising this phase at room temperature and helping it withstand the final quenching step without transforming to martensite.

As used in this disclosure, the term "carbide-free bainitic steels", or its acronym "CFB steels", refers to refers to steels produced by a heat treatment with a carbide-free bainitic (CFB) process, whose microstructure includes only bainite and retained austenite. The CFB process is schematically presented in FIG. 1D. From its carbide-free nature, bainite is composed of bainitic ferrite plus retained austenite as a carbon-rich phase. In these steels, different from normal bainitic steels, carbides are replaced by the retained austenite, due to decreased kinetics and thermodynamic driving force for carbides formation, and stabilized austenite. They represent relatively a high level of strength, even among the third generation AHSS, with fairly high ductility. They are heat-treated initially in a single phase region where the temperature is higher than $A_{c3}$, in order for all the microstructure to transforms into austenite, thereafter quenched to the temperature between the $M_s$ temperature and the $B_s$ temperature with fast enough quenching ratio to avoid ferrite formation. Subsequently, they are isothermally heat-treated at the quenched temperature until the bainite formation completes. This process is nothing different from traditional bainite steels, but the isothermal holding temperature is much lower than the conventional ones. This very low temperature leads to very fine microstructure and high dislocation density, both of which enhances the strength level. The dispersed retained austenite phase triggers TRIP effect, thereby enabling good formability even with their high level of strength. Similarly to the Q&P steels, austenite is stabilized by the carbon partitioning from bainitic ferrite to austenite, whereas it is from martensite to austenite in the case of Q&P. In spite of their impressive strength, however, because of its insufficient weldability due to a high amount of alloying elements and limited productivity due to lengthy heat-treatment required at low temperatures, they have mainly applied to the field of rail steels, not being applied to automotive construction so far where intensive welding is necessary.

As used in this disclosure, the term "transformation induced plasticity", or its acronym "TRIP" refers to a deformation mechanism in which austenite transforms to hard martensite during mechanical deformation, which is one of the most exciting phenomena in steel metallurgy that enables unique strength ductility combinations in high strength steels. The transformation provides additional ductility by stabilizing plastic deformation and delaying tensile necking. The excellent combination of strength and ductility make these steels suitable for wide ranging applications. The class of steels with improved properties due to austenite to martensitic transformation during deformation are commonly deemed TRIP steels.

Transformation plasticity with regards to martensitic transformations arises due to biasing of accommodation slip triggered by transformation shape strain, and martensitic transformation net shape strain due to stress biasing of martensite orientation variants. The martensitic transformation during deformation results in controlled strain hardening which is crucial to inhibit flow instability and delay the onset of necking. Studies on the TRIP effect showed the improvement in mechanical properties due to reverse curvature of the $\sigma-\varepsilon$ curve that postpones plastic localization such as tensile necking and shear fracture. The interplay of transformation kinetics and plastic flow behavior in TRIP steels has been studied in depth by Olson and Azrin by measuring the stress strain behavior during uniform as well as localized deformation.

It is shown that austenite to martensite transformation can occur spontaneously at pre-existing defects below a temperature defined as martensite start ($M_s$) temperature. The free energy difference between austenite and martensite at $M_s$ equals to the critical free energy required for the transformation. At a temperature above $M_s$ and below $M_d$, where $M_d$ is a temperature above which no transformation occurs on deformation to fracture, transformation can occur aided by a mechanical driving force in addition to the chemical driving force. Above $M_d$ temperature the total driving force (chemical+mechanical) is unable to surpass the critical driving force making transformation no longer possible. At temperatures in between $M_s$ and $M_d$, the deformation induced transformation behavior is divided into two different transformation modes: (1) stress assisted mode at low temperatures with yielding by transformation; and (2) strain induced mode at higher temperatures with yielding by slip.

As used in this disclosure, the term "coupled diffusional/displacive phase transformations" refers to a solid-solid phase transformation in materials that results in non-equilibrium growth of a product phase with or without any associated composition change. Martensitic transformation is an example of non-equilibrium growth of a phase without any composition change. On the other hand, restricted equilibrium conditions such as para-equilibrium result in interstitial diffusion that results in equilibration of their chemical potential while substitutional additions are frozen in place. A more general case of non-equilibrium growth with compositional change would be the case where there is partial supersaturation of interstitials in the product phase and growth is mediated by the process of structural change across the interface. Olson, Bhadeshia and Cohen modeled the non-equilibrium growth of ferrite plates from austenite in Fe—C alloys where the structural transformation is displacive and derived how partitioning of solute would modify the nucleation and growth behavior during bainite transformation as a coupled process. The partitioning of carbon increases the available free energy for transformation thus allowing for assisted displacive transformation above the $M_s$ temperature. This defined the so called "coupled diffusional/displacive transformation".

As used in this disclosure, the term "$B_a$ temperature" refers to a temperature at which coupled diffusional/displacive bainitic transformation starts in a given alloy. Similar to $M_s$, the $B_s$ reflects the amount of thermodynamic driving force required to initiate the shear transformation, but different from $M_s$, it is associated with interstitial carbon diffusion. That is, at $B_s$ temperature, the driving force which is defined as the excess in chemical free energy per mole of austenite over that of bainite of the same composition is to be identical to the critical driving force. Furthermore, the maximum value of the driving force accompanied with carbon diffusion from bainitic ferrite into the retained austenite surrounding it can be decided by using the parallel tangent construction. In this sense, $B_s$ temperature can be deduced by solving the temperature where the maximum driving force equals to critical driving force. At $B_s$ temperature, full-partitioning of carbon is assumed under para-equilibrium constraints.

As used in this disclosure, the term "$M_s$ temperature" refers to a temperature at which martensitic transformation starts in a steel during cooling when the austenite reaches the martensite start temperature ($M_s$) and the parent austenite becomes mechanically unstable. As the steel is quenched, an increasingly large percentage of the austenite transforms to martensite until the lower transformation temperature $M_f$ (martensite finish temperature) is reached, at which time the transformation is completed. Martensite is formed in carbon steels by the rapid cooling (quenching) of the austenite form of iron at such a high rate that carbon atoms do not have time to diffuse out of the crystal structure in large enough quantities to form cementite ($Fe_3C$). Austenite is γ-Fe, (gamma-phase iron), a solid solution of iron and alloying elements. As a result of the quenching, the face-centered cubic austenite transforms to a highly strained body-centered tetragonal form called martensite that is supersaturated with carbon. The shear deformations that result produce a large number of dislocations, which is a primary strengthening mechanism of steels. In certain alloy steels, martensite can also be formed by the working and hence deformation of the steel at temperature, while it is in its austenitic form, by quenching to below $M_s$ and then working by plastic deformations to reductions of cross section area between 20% to 40% of the original. The great number of dislocations, combined with precipitates that originate and pin the dislocations in place, produces a very hard steel. This property is frequently used in toughened ceramics and in special steels like TRIP steels. Thus, martensite can be thermally induced or stress induced.

As used in this disclosure, the term "$M_s^{\sigma}$ Temperature" is an austenite start temperature referring to a temperature at which the material can withstand the maximum stress before yielding due to martensitic transformation or slip deformation. It is also the temperature at which the deformation induced transformation mode changes from stress assisted to strain induced. $M_s^{\sigma}$ temperature has been established as a quantitative measure of the retained austenite stability. It is especially useful as it can be theoretically calculated using thermodynamic models and experimentally measured with tensile test experiments. According to the Olson-Cohen model, when the temperature is at $M_s^{\sigma}$ temperature and stress applied is at the yield stress for slip, the sum of chemical driving force and mechanical driving force for transformation equals the critical driving force required for martensitic transformation. Using established descriptions and those developed in the invention for the free energy terms as a function of temperature and composition, the $M_s^{\sigma}$ temperature for any austenite composition and size can be calculated.

$$\Delta G_{chem}+\Delta G_{mech}=\Delta G_{crit} \text{ at } T=M_s^{\sigma} \text{ and } \sigma=YS_{slip}$$

The chemical driving force ($\Delta G_{chem}$) for transformation is calculated using the ThermoCalc software with a proprietary database (developed from the kMART database) suited specifically for low-temperature martensite transformation calculations. $G_{chem}$ is defined as a function of the chemical composition and temperature i.e., $\Delta G_{chem}=F(X_i, T)$, where i=C, Mn, Si and other alloying elements. The chemical driving force for martensitic transformation is the difference between the free energy of the body-centered cubic (BCC) and face-centered cubic (FCC) phases.

$$\Delta G_{Chem}=G_{BCC}-G_{FCC}$$

The mechanical driving force ($\Delta G_{Mech}$) considers the effect of applied stress on the orientation distribution of the existing nucleation sites. It is stress state dependent due to the interaction of applied stress with the transformation volume change. The relation of $\Delta G_{Mech}$ to the applied stress is given by the equation below. The parameter $$\left(\frac{\partial \Delta G_{Mech}}{\partial \sigma}\right)$$

in the equation is a function of the stress state.

$$\begin{aligned}\Delta G_{Mech} &= \sigma\left(\frac{\partial \Delta G_{Mech}}{\partial \sigma}\right)\\ &= -0.718\sigma - 6.85\left(\frac{\Delta V}{V}\right)\sigma_H + \\ &\quad 185.3\left(1 - e^{-0.003043*\sigma}\right) \text{ in J/mol}\end{aligned}$$

where $\sigma_H$, $$\text{hydrostatic stress state} = \sigma/3$$

for uniaxial tension; σ=von Misses equivalent stress, fractional volume change upon transformation $$\frac{\Delta V}{V} = 0.04.$$

The critical driving force is accounted as the sum of the nucleation defect potency ($G_n$) and the frictional work of interfacial motion due to solid solution hardening ($W_F^{SS}$) and forest dislocations ($W_F^{D}$) as defined by Behera. The nucleation defect potency has contributions from the transformation elastic strain energy ($G_{et}$) and interfacial energy due to newly formed interfaces described by the $$\left(\frac{2\gamma}{nd}\right)$$

term, where γ is the specific fault/matrix interfacial energy, n is the defect potency (size) and d is the close-packed interplanar spacing. The solid solution frictional work of interfacial motion during martensite nucleation ($W_F^{SS}$) described by the equation below is a function of the chemical composition of retained austenite and has an a thermal and thermal component as quantified in the work of Ghosh and Olson. The frictional work due to the forest dislocations ($W_F^D$) is derived as a function of partitioning temperature by calibrating the model with experimentally measured values of the $M_s^\sigma$ temperature.

$$\Delta G_{Crit} = -G_n - W_F^D - W_F^{SS}$$

where $\Delta G_{Crit}$ is a critical driving force for martensitic transformation, $$G_n = G_{el} + \frac{2\gamma}{nd},$$

and $W_F^{SS} = W_F^{SS}$ (athermal)+$W_F^{SS}$ (thermal). In the stress assisted regime, yield stress at different testing temperatures can be calculated upon equating the sum of chemical and mechanical driving force to the critical driving force for martensitic transformation. The final form of transformation yield stress in the stress-assisted regime is described below. The slip yield stress variation with temperature in the strain-induced regime is measured experimentally via multiple specimen tensile test experiments. The intersection of the yield stress plots in the two regimes gives the $M_s^\sigma$ temperature.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

At the core of the development of modern automotive steels with improved properties is the effort focused on AHSS. The automotive industries exhibit strong desire for improved strength with sufficient amount of ductility, hole-expansion ratio and cost effectiveness and with sufficient or improved level of weldability. CFB steels have proved a superior strength level among the third generation AHSS with sufficient ductility, whereas their production cost and weldability are not applicable to automotive constructions. They require very long heat-treatment at very low temperatures, which significantly lowers productivity thus total cost for materials production. They also contain a high amount of carbon to enable bainite formation at low temperatures, which severely damages the weldability. Another promising type of the third generation AHSS, Q&P TRIP steels, also have proven successful combinations of strength, ductility and cost. They exhibit a middle level of (strength*total elongation level) among the third generation AHSS. They can also be produced with relatively low extra materials production cost, since it can be produced with a minor facility investment in the conventional production line, without significant reduction of productivity. However, because of the inevitably forming carbides within martensite region, their mechanical performance (strength*total elongation) are limited compared to CFB steels. Also, their multi-phase microstructure with significant strength difference between ferrite and martensite lowers the hole-expansion ratio, as the interface between these two phases is prone to crack and expand. However, both CFB and Q&P steels have their unique limitations on either of the required performance or constraints from the automotive industry.

A significant number of research efforts have been undertaken to get the best performance out of the third generation AHSS, especially Q&P and CFB steels. Most efforts rely on an empirical design of experiments approach to quantify the effect of individual factors including overall composition and processing parameters. Although useful correlations have been obtained from these efforts, it is difficult to separate out effect of one parameter as there are many parameters that are highly interdependent.

One of the objectives of this invention is to provide, evaluate and enable a new concept, i.e., the C&P process/treatment, in the third generation AHSS steel designs, in order to breakthrough limitations of existing materials, thereby contributing to improvements of transportation systems.

Fully-bainitic microstructure with bainitic ferrite and retained austenite is suitable for this objective, in terms of both total elongation and hole-expansion ratio. This microstruture can trigger the TRIP effect due to the presence of the retained austenite at the application temperature. It can also avoid formation of carbides, which are typically formed in Q&P TRIP steels and reduce the amount of the retained austenite thus the TRIP effect, because the bainitic ferrite contains a lower density of nucleation sites for carbides compared with the martensite region in Q&P TRIP steels. In addition, it benefits the hole-expansion ratio as well, since it contains less strength difference in the existing phases. In CFB steels, the phases are only ferrite and retained austenite, whereas Q&P steel contains martensite in addition to them. Conventional design and production method for CFB steels cannot be simply applied to achieve desired CFB mictroctructure, since it contains too much carbon as an alloying element and requires too long heat-treatment.

In order to overcome these disadvantages of CFB steels, this invention discloses a new process, i.e., cooling and partitioning (C&P), for the third generation AHSS steels. In one embodiment shown in FIG. 1A, the C&P process initiates from fully-austenization treatment above the $A_{c3}$ temperature, then experiences succeeding quenching to a bainite region between the $M_s$ temperature and the $B_s$ temperature, where the $A_{c3}$ temperature is a temperature at which the transformation from ferrite into austenite is finished. After quenching, it goes through optimally-controlled continuous cooling. The "optimal" means that the temperature of the alloy should always be controlled at just above the evolving $M_s$ temperature, so that the fully-baintic structure is insured. As shown in FIG. 2, which schematically describes how the microstructure of bainite evolves during the C&P process according to the invention, the $M_s$ temperature keeps decreasing after quenching, since carbon keeps partitioning from the bainitic ferrite to the retained austenite during the optimal cooling process. Accordingly, the C&P process overcomes disadvantages of CFB TRIP steels having low weldablitiy and productivity. The active usage of the carbon partitioning allows one to reduce the total component of carbon in the alloy design, even though it enables as high carbon in the austenite phase as the conventional CFB TRIP steels. This greatly improves the weldability of the CFB TRIP steels, because carbon is the most notorious element for lowering weldabiltiy and reducing it significantly improves the weldability. The C&P process also enhances the productivity, since the cooling process in the C&P process starts from relatively higher temperatures than conventional CFB production, whereas finally reaches as low temperatures as CFB. This means that bainitie formation can partially be accelerated due to relatively high temperatures at the initial stage of the cooling, which enhances productivity. At the same time, microstructures can be still sufficiently refined and austenite be stabilized at the final stage of the cooling process, where the temperature can be lowered to the same level as the conventional CFB TRIP steels.

Specifically, one design approach according to the invention is to develop ICME (integrated computational materials engineering) based mechanistic models grounded in quantitative phase transformation and transformation plasticity theory to predict the key microstructural characteristics that control the desired properties. In certain embodiments, the C&P process is utilized as an example process for this scientific and mechanistic approach. The developed thermodynamic and kinetic models fully incorporate the effect of alloy composition and processing parameters. The models calibrated with characterization measurements can then be used to computationally design an alloy composition and process cycle to achieve the best mechanical properties. According to embodiments of the invention, accurate experimental data for carbon partitioning using high resolution characterization techniques such as 3DAP and HEXRD are provided; thermodynamics-based predictive models are calibrated for austenite carbon enrichment as a function of alloy composition and processing parameters; the variation of austenite stability is evaluated with the C&P processing parameters, and thermodynamic models is calibrated to predict austenite stability for any given alloy composition and C&P cycle; the calibrated models for austenite carbon content and its stability after the C&P processing are validated; and the variation in competing carbide precipitation with processing conditions is quantified, and possible thermodynamic parameters that could be used to predict its precipitation behavior are determined.

Furthermore, according to embodiments of the invention, the effectiveness of the C&P method is evaluated by experimentally validating the mechanical performance such as strength, total elongation and hole-expansion ratio, with sufficient level of weldability and productivity. Further discussion with automotive industry is required to quantify the target value for each performance factors. By utilizing the above model, the optimal materials design and production conditions in the C&P method are evaluated. It is desirable for the model to be able to predict not only the mean value but also the minimum value of each performance, taking into account the fluctuations of the process conditions. In turn, the model can also be utilized to identify the possible fluctuations in the production conditions, temperature or cooling rate variations, for example, to insure required minimum performance. Material design is then calibrated to the actual possible mass-production conditions. As disclosed above, the C&P heat-treatment can be applied after either hot-rolling or cold-rolling in steel sheet production. In the case of after hot-rolling, the C&P treatment should initiate in the water cooling process, which comes right after hot-rolling in hot-rolling factories. It can be either totally finished in the water cooling process, or continued in the air-cooling process, which happens after coiling process where water-cooled sheet steels are rolled into shape of coils. Or, in the case of the C&P treatment performed after cold-rolling, it should be finished in the furnace-controlled heat-treatment process after cold-rolling.

The traditional process of new alloy or process development involves the commonly used trial and error methods that have the obvious drawbacks of being expensive and overly time consuming. In contrast, as disclosed in the invention, a systems-based approach that integrates the process/structure/property/performance relations for a predictive design of multilevel-structured high performance materials has now been proven to be more useful and economical. The materials by design methodology use the goal/means approach to design a material or process with a desired level of performance. The desired performance decides the property objectives that define the microstructure requirements. The established relationship of processing with microstructure aids in the design of an optimal processing route that results in the desired microstructure.

Figure 4:
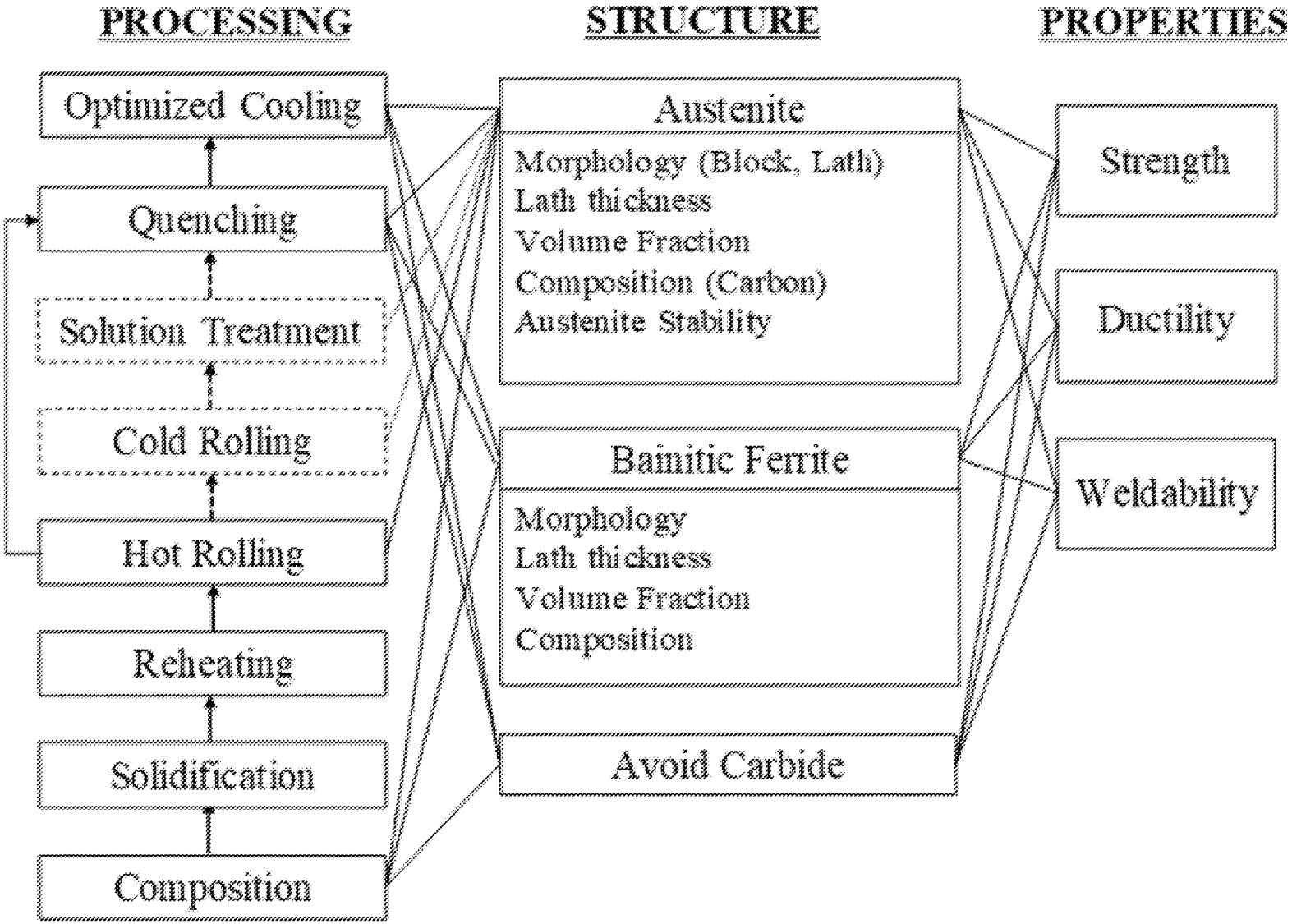
FIG. 4 shows schematically a system design chart for the C&P process according to one embodiment of the invention.

In certain embodiments, the design approach for the C&P steels/alloys can be represented by further breaking down the four primary elements: processing, structure, properties and performance, and portraying their interactions across a multiscale hierarchy of subsystems by a system flow-block diagram shown in FIG. 4. The desired performance standards for the C&P steels are defined in the property objectives of tensile strength, uniform ductility, hole expansion ductility and alloy cost. Exemplary embodiments of the invention focus on maximizing the combination of tensile strength and ductility. The relationship of microstructure to properties for these alloys is established. The key structure parameters influencing the properties are the austenite phase fraction and composition in addition to ferrite morphology and avoiding carbide precipitation. The connection of processing to the structure of the material is derived. The important processing variables affecting the key structure parameters are alloy composition, quench temperature, final partition temperature. Detailed understanding and predictive modeling of the interplay between the individual elements of processing, structure and properties are critical to design a material to achieve desired performance level.

In certain embodiments, a trial design for the C&P steels starts from deciding the trial composition for the C&P treatment, and producing the test samples. The trial alloy should have high enough hardenability to avoid formation of ferrite, and contains carbon no more than 0.4 wt % for weldability and silicon no less than 1.0 wt % for carbide prohibition. The sample can be hot-rolled or cold-rolled, since the actual heat-treatment for the C&P TRIP steels can occur after either of them.

Figure 6A:
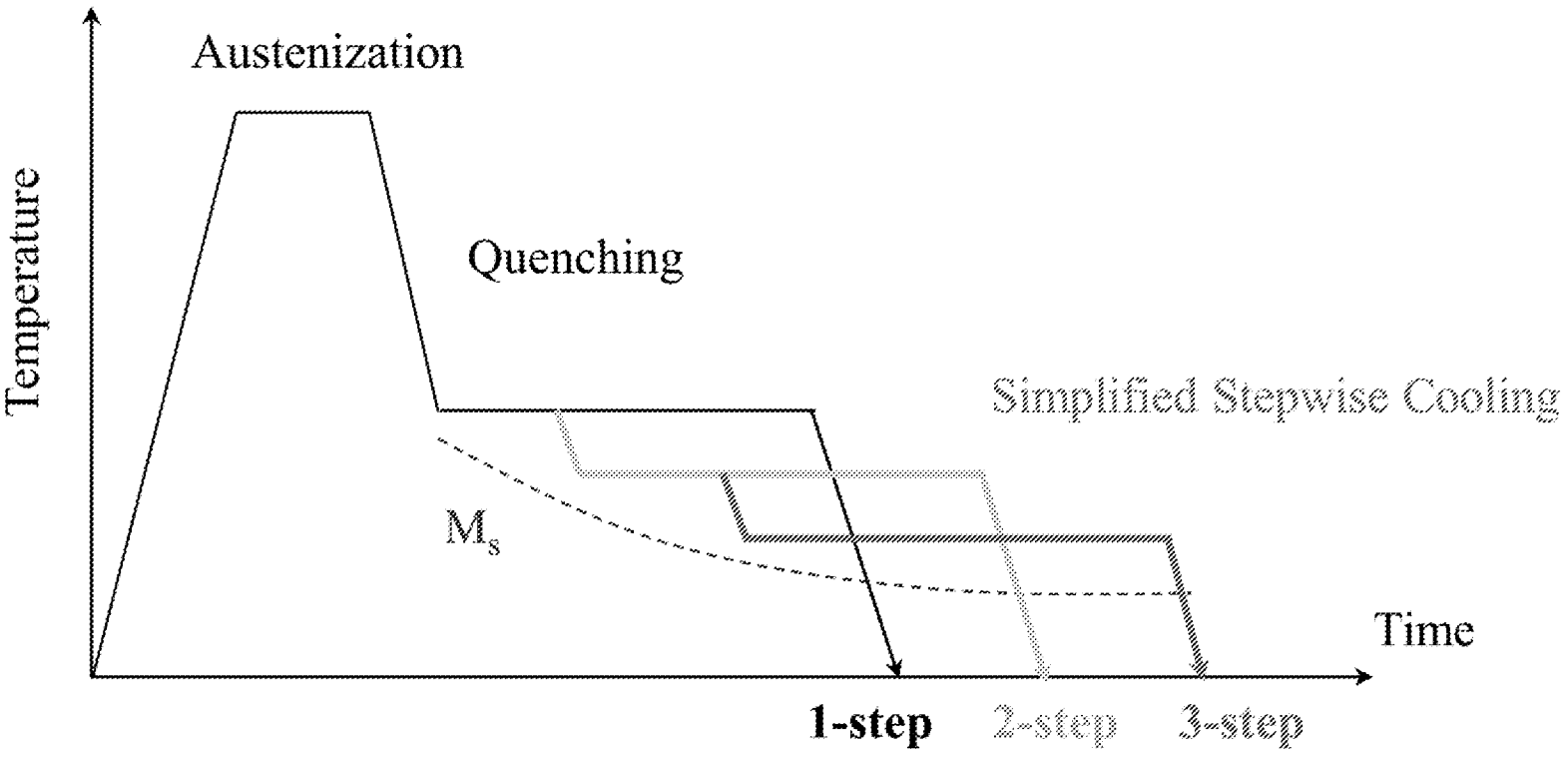
FIG. 6A shows schematically the C&P process with the simplified step-wise cooling according to one embodiment of the invention.

Furthermore, the trial design is experimentally testified to prove effectiveness of the proposed method, evaluated developed non-equilibrium thermodynamic models and help further iterations of the design. Details of the experimental evaluations are discussed below. In certain embodiments, instead of applying gradual cooling, simplified step-wise cooling is applied, in order to better identify different behaviors at different temperatures, such as kinetics of bainite formation, descent of the $M_s$ temperature, carbon concentration in austenite and morphologies of microstructure. FIG. 6A shows schematically the C&P process with the simplified step-wise cooling according to one embodiment of the invention.

Initial State Evaluation: The cold-rolled or hot-rolled sample materials are utilized to evaluate as-received $M_s$ temperature, $B_s$ temperature and bainite start time at several different temperatures. The $M_s$ and $B_s$ temperatures are necessary to identify the quenching temperature in the C&P process which lies between those temperatures to insure the fully-bainitic structure. Bainite start time is required to deduce the allowed slowest cooling rate in the quenching step, to totally avoid ferrite formation. These conditions, the initial quenching temperature and critical cooling rate are important process parameters in the C&P treatment. In certain embodiments, they are experimentally evaluated using specific equipment which can both execute heat-treatment and measure dilatation during the heat cycle. The lattice structural change due to phase transformation during the heat-treatment is explicitly identified from the dilatation data, thereby accurately deciding the phase transformation temperature and kinetics. The equipment is either Quench Dilatometer, Gleeble, or Formaster. Acquired data from these experiments are plotted into time-temperature-transformation (TTT) diagram. The data are also utilized to evaluate, calibrate and improve the martensite and bainite phase transformation model which is described later.

End State Evaluation: In the C&P process, the final partitioning temperature is critically important, since it decides diverse important features such as the finest lath thickness of bainitic ferrite and retained austenite, austenite stability which is mainly influenced by the carbon concentration and lath thickness, volume fraction of austenite, etc. Hence, intensive analysis on the microstructure, phase compositions and the mechanical performance are performed with regard to the final partitioning temperature. In certain embodiments, the following experimental evaluations are performed to evaluate the status at the final state.

A. Microstructural analysis: Morphology of retained austenite and bainitic ferrite is observed through Scanning Electron Microscopy (SEM) and Electron Backscatter Diffraction (EBSD). After Nital etching, SEM imaging provides morphological information on both retained austenite and bainitic ferrite phases. After vibratory polishing, EBSD analysis helps one better identify the presence of carbides and fresh martensite.

B. X-ray diffraction analysis: X-ray diffraction analysis is effective in identifying volume fraction of austenite phase and its carbon concentration. It measures the diffraction pattern from the very surface of the sample, whose diffraction angle and intensity represent the lattice parameter and phase fraction, respectively. High energy X-ray diffraction experiment is also performed in the Argonne National Laboratory, for the very accurate measurements. X-ray diffraction measurement is suitable for the mean value analysis, since it provides averaged property inside X-ray, whose spot size is typically in the order of millimeters.

C. Atom probe tomography: Dimensional local electrode atom probe tomography (3D LEAP) is performed to accurately measure compositional distribution among different phases and morphological information of them. Samples for 3D LEAP are either prepared by electrical polishing or focused ion beam (FIB) milling. FIB milling is desirable if targeting specific area of interest is necessary. 3D LEAP is suitable for analysis on the local information, whose observation area is typically in the order of sub-micrometers.

D. Mechanical Testing: In order to evaluate mechanical performance such as yield strength, total elongation and fracture ductility, normal mechanical testing is performed. It is also important to evaluate and control the $M_s^o$ temperature, in order to maximize strength and ductility at the application temperature. In certain embodiments, the $M_s^o$ temperature is evaluated via Bolling-Richman single specimen technique. Hole-expansion ratio is also performed since fracture ductility is as important as uniform ductility in automotive applications where severe deformation is required. It is known that the hole-expansion testing does have wide fluctuations. However, it is shown that inverse of reduced area during tensile testing correlates well with the hole expansion ratio. Hence, it is possible to evaluate reduced area instead of directly evaluating hole-expansion ratio.

Transitional Path Evaluation: In realizing the C&P process, it is important to evaluate how the $M_s$ temperature decreases during the cooling treatment, because the alloy temperature should always be kept at just above the $M_s$ temperature to avoid martensite formation. In this sense, the experimental evaluation is performed to identify the $M_s$ temperature at different process times. In certain embodiments, the $M_s$ temperature at different times is measured by suspending the C&P treatment at the timing of interest, and directly quenching the sample to room temperature. This is performed with an experimental setup where both temperature and dilatation can be measured.

In addition, another important approach is computational modeling of the phenomena happening during the C&P treatment. It is of great significance to decide which the phenomenon to be modeled as well as how to model it, in order to design a material with accuracy and efficiency. Once the models are established and calibrated to the experiments, one can design the optimal material with the aid of computational trial and error, which is much less expensive in both time and money compared to the experiments.

Initial State Modeling: It is beneficial to be able to computationally predict the $M_s$ and $B_s$ temperatures so that one can decide the quench temperature in the C&P process, which is between $M_s$ and $B_s$, without performing any experiments. The theory for displacive and coupled diffusional/displacive transformation described above is thoroughly incorporated into the fe-martbain model developed by Questek. In certain embodiments, this fe-martbain model is first calibrated to experiments described above, then actively utilized in the design to identify where quench temperature should be set for a composition of interest.

End State Modeling: End state modeling is crucial for predicting the mechanical performance of the C&P TRIP steels. In certain embodiments, intensive modeling is performed, utilizing a composition and a final partitioning temperature as an input. The modeling includes, but is not limited to:

A. Predicting a carbon concentration in the austenite phase at the final partitioning temperature utilizing Thermocalc software under para-equilibrium constraints, with effective stored energy added to the BCC phase. In certain embodiments, the effective stored energy concept is demonstrated and a frictional work term is calibrated using the measured carbon concentration value from X-ray diffraction experiments.

B. Predicting an optimal partitioning temperature utilizing the Olson-Cohen $M_s^o$ model which provides the $M_s^o$ temperature. It is proved that the important mechanical properties, such as the total elongation and the hole-expansion ratio correlated with a reduced area in tensile testing, are maximized at 20° C. higher than the $M_s^o$ temperature. In certain embodiments, by controlling the $M_s^o$ temperature 20° C. lower than an application temperature, one can maximize ductility in the application. By having a computational model to predict the $M_s^o$ temperature at different partitioning temperatures and alloy compositions, an optimal partitioning temperature is specifically designed, for the $M_s^o$ temperature to be 20° C. lower than the application temperature.

C. Predicting the required process time at the final partitioning temperature. This is performed either by utilizing the coupled diffusional/displacive model for bainite kinetics, or by DICTRA simulations for calculating homogenization time required at the final partitioning temperature. In the case of the coupled diffusional/displacive model for bainite kinetics, the model has to be incorporated with a carbon partitioning effect to predict bainite kinetics below the $M_s$ temperature. The DICTRA calculations not only provide the required homogenzation time, which is directly connected to the required process time, but also provides a good estimate of how long the process should take for an alloy composition of interest.

Transitional Path Modeling: It is crucial to evaluate the $M_s$ descent curve during the cooling process in the C&P treatment so as to reach down to the optimal partitioning temperature while avoiding formation of martensite. This curve can be experimentally validated, but it is helpful if the computational approach is enabled. In certain embodiments, the $M_s$ temperature during the cooling treatment is predicted, by combining the DICTRA calculations and the fe-martbain model. Using DICTRA, one can predict a minimum carbon concentration value in the austenite phase during ongoing cooling, where carbon is austenite is not homogenized. By assuming this minimum value gives a new $M_s$ temperature, one can predict that the new $M_s$ by utilizing the fe-martbain model, with a carbon composition set to the minimum value provided by DICTRA. This approach is experimentally calibrated with atom probe tomography, thereby a carbon distribution within the austenite phase is obtained. By comparing experimental and predicted carbon distributions in austenite, an accurate prediction of the $M_s$ descent curve upon cooling is enabled.

Figure 5:
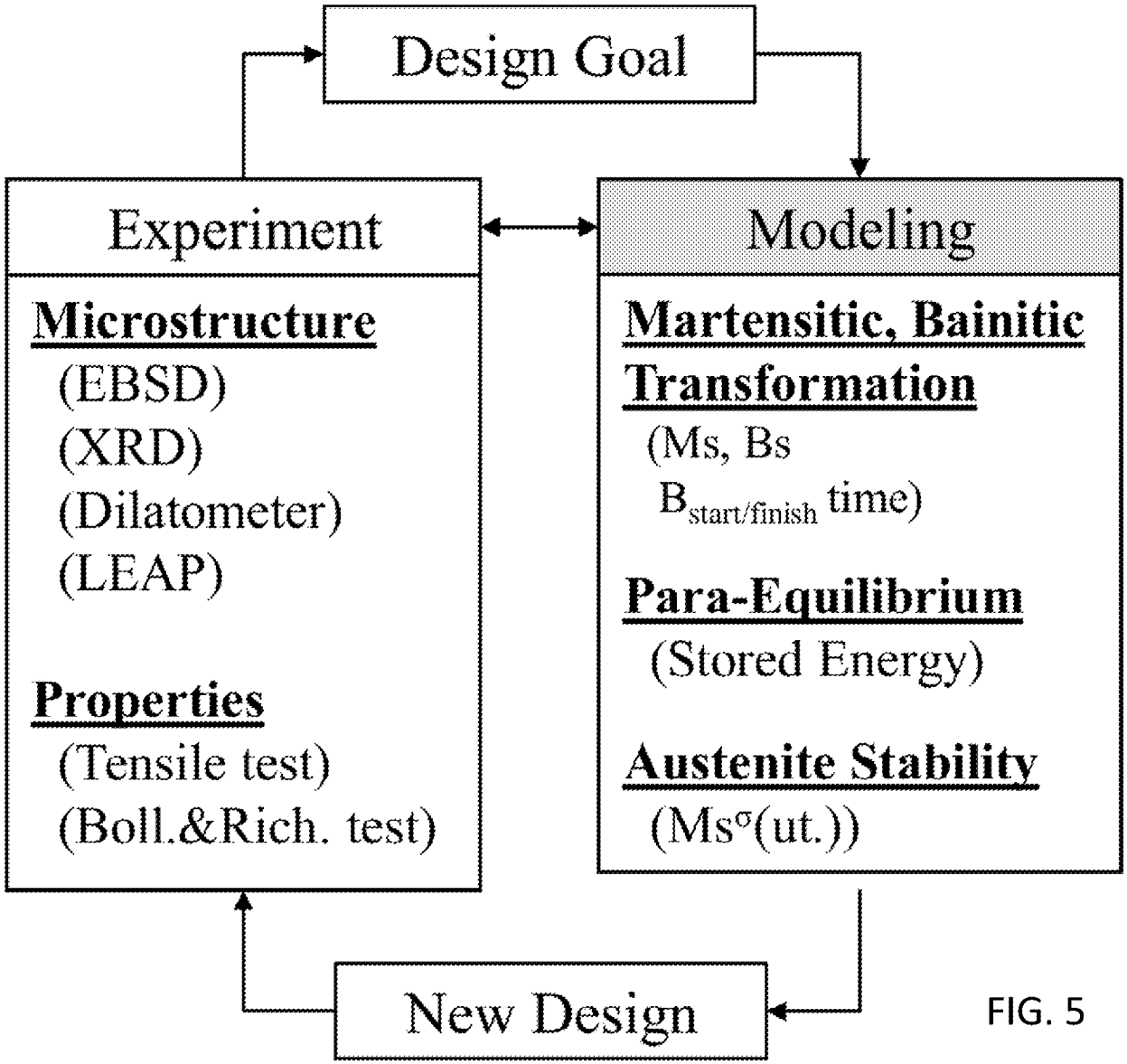
FIG. 5 shows a schematic illustration of iterative design by an ICME approach according to one embodiment of the invention.

Moreover, starting from the trial design and production of the C&P steels, the design also includes continuously and experimentally evaluating the effectiveness of the C&P treatment. Also, this experimental information is thoroughly utilized for the calibrations of the models developed to design the C&P TRIP steels. Once these steps are completed, several design iterations are performed to achieve the best C&P TRIP steels to satisfy automotive requirement, and to have the most accurate models to be available for material designers. This design iteration concept is schematically illustrated in FIG. 5.

According to the invention, among other things, the C&P process improves the spot-weldability of steel, by reducing the carbon content. It also improves the strength of the steel, by avoiding the formation of carbides. It further improves the ductility of the steel, by avoiding the formation of carbides. Therefore, the C&P process may find a variety of applications in the fields of high strength sheet steel production, high strength plate steel production, high strength bar and forging steel production and austempered cast iron.

Figure 2:
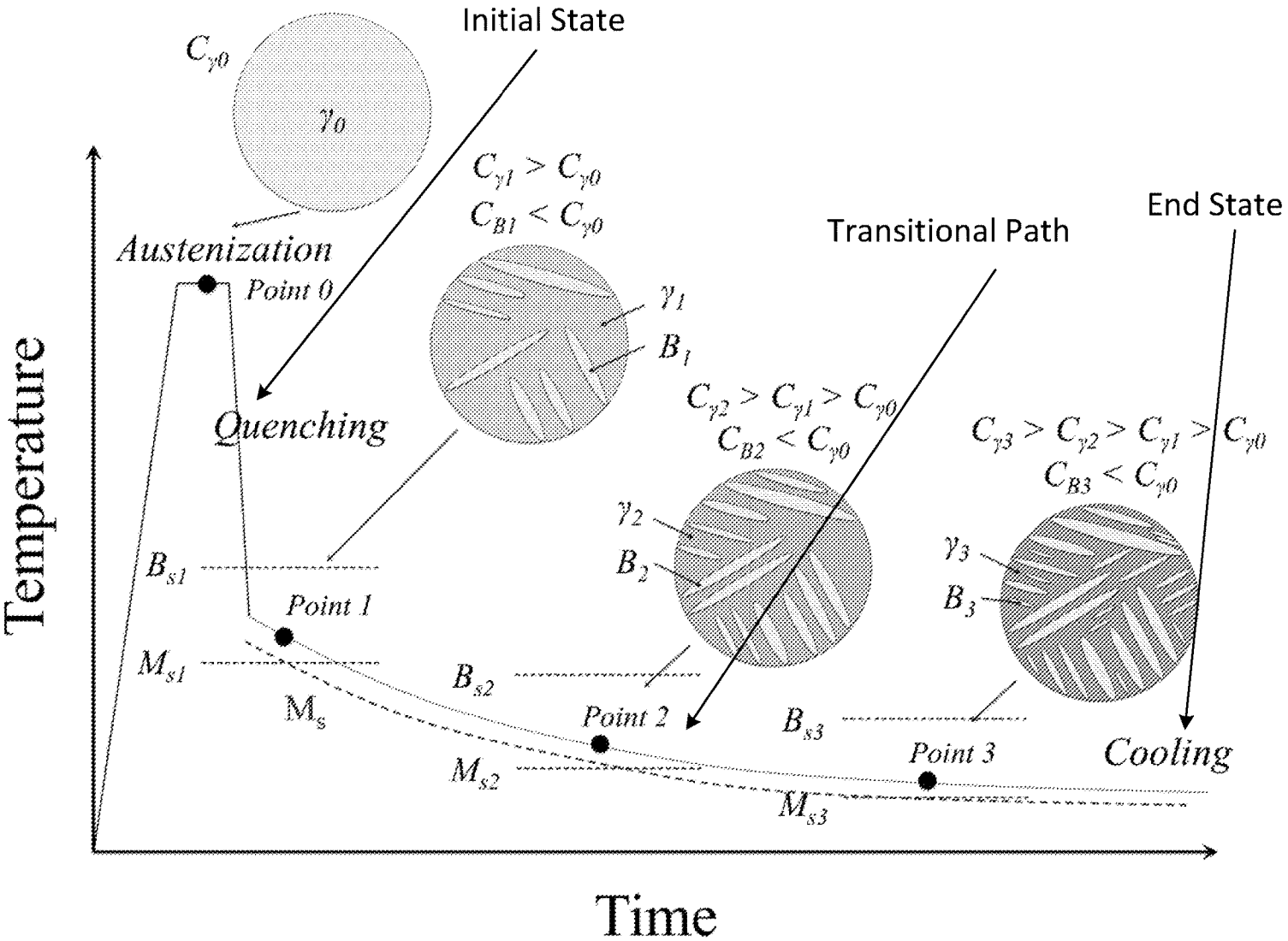
FIG. 2 shows a schematic illustration of the microstructural evolution during the C&P process/treatment according to one embodiment of the invention.

In one embodiment of the C&P process, as shown in FIG. 1A, quenching after austenization or hot rolling down to just above the $M_s$ temperature, and succeeding optimized cooling are performed. Quenching is fast enough cooling to avoid ferrite, also avoiding martensite by finishing the quenching at above the $M_s$ temperature. Next optimized cooling stage forms bainite and retained austenite. The steel contains high enough silicon content so that any type of carbides is suppressed. During this cooling stage, the carbon partitions from bainitic ferrite to retained austenite, which stabilizes the retained austenite. This increased austenite stability decreases the $M_s$ temperature, as the cooling goes on. The cooling ratio of the optimal cooling stage is precisely controlled so that the temperature of the steel alloy continues to be just above the $M_s$ temperature which keeps decreasing during the cooling. This method enables one to achieve extremely fine microstructures of bainite and retained austenite without any type of carbides. The steel alloy shows great performance in both the tensile strength and elongation, due to its extremely precise microstructures. The existence of the retained austenite phase also improves the mechanical properties, because of the TRIP effect. In addition, the C&P process allows one to decrease the carbon content in the initial alloy design, since carbon partitioning is effectively utilized in order to stabilize austenite. The decreased level of the carbon content improves spot weldability of the steel alloy.

Figure 1B:
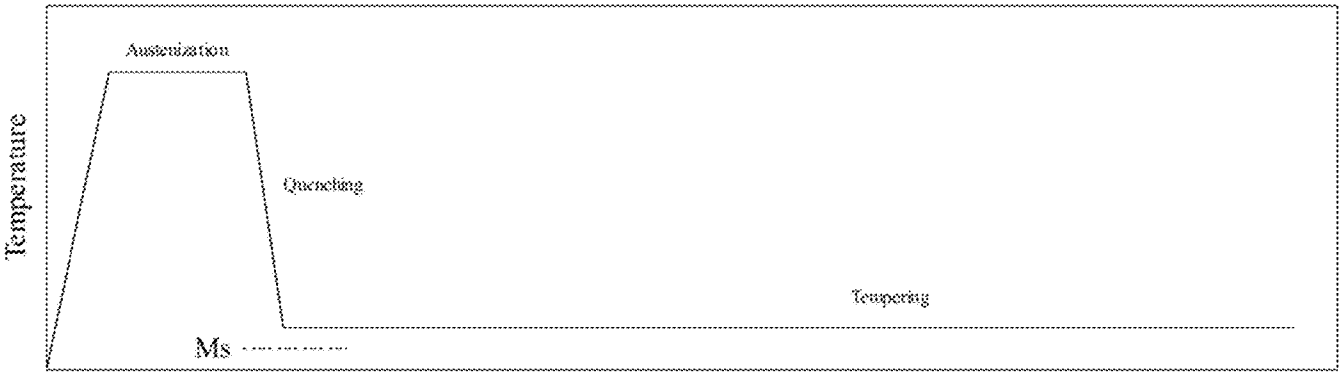
FIG. 1B (Prior Art)
Figure 1D:
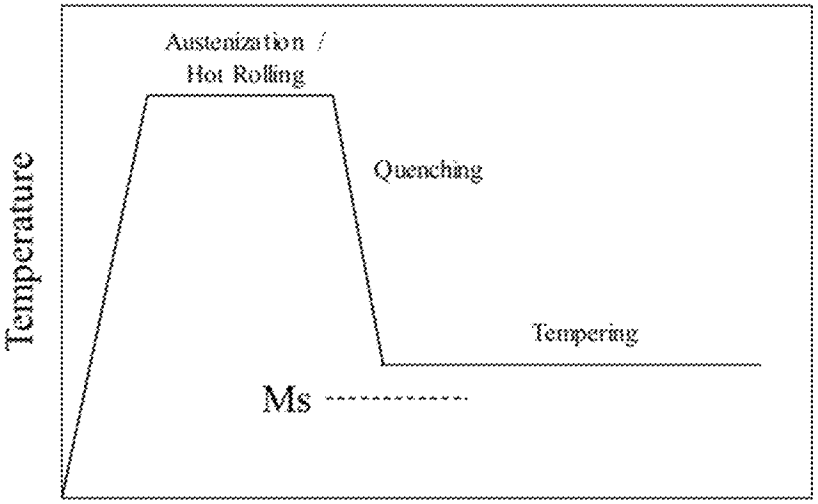
FIG. 1D (Prior Art)
Figure 1C:
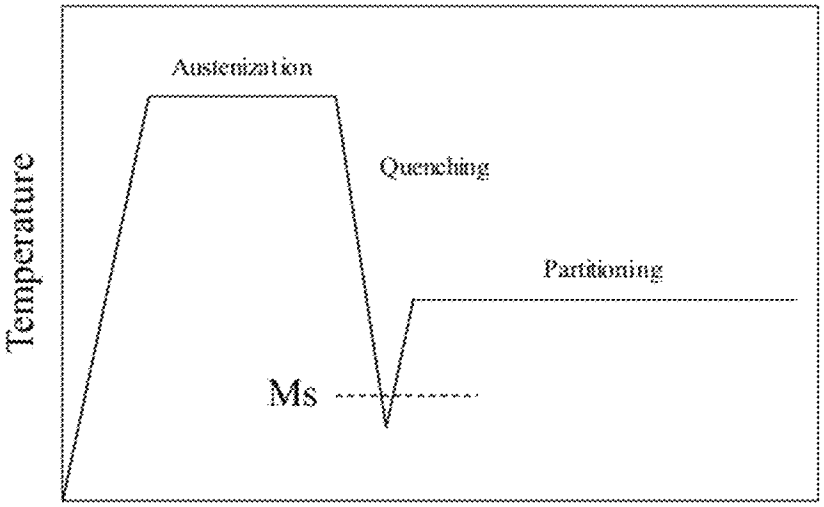
FIG. 1C (Prior Art)

The C&P process according to the invention is superior to the Q&P process shown in FIG. 1C. The Q&P process includes quenching to below the $M_s$ temperature, forming fractional martensite and heating up to a certain temperature where the carbon portioning is performed. In the partitioning stage, carbon transfers from martensite to austenite, which stabilizes the austenite. However, carbides inevitably form inside the martensite during partitioning stage, which decreases the carbon level in the austenite and destabilizes it. Unstable austenite leads to a smaller volume fraction of retained austenite. Decreased volume fraction of austenite means less TRIP effect, which deteriorates the mechanical properties. The C&P process of the invention resolves this problem by not having any martensite where carbides easily precipitate, which leads to superior mechanical properties of the steel produced by the C&P process.

The C&P process according to the invention is also superior to the conventional CFB process shown in FIG. 1D. The CFB process includes quenching to above the $M_s$ temperature and succeeding tempering stage which is isothermal holding, forming bainite. The C&P process of the invention enables superior mechanical properties to the CFB process, because finer microstructures are enabled in the C&P process by gradually lowering tempering temperature in the optimized cooling stage. It is well known that bainite formed at lower temperature provides finer microstructures and higher strength. Further, the C&P process according to the invention also overcomes disadvantages of CFB TRIP steels having low weldablitiy and productivity. The active usage of the carbon partitioning allows one to reduce the total component of carbon in the alloy design, even though it enables as high carbon in the austenite phase as the conventional CFB TRIP steels. This greatly improves the weldability of the CFB TRIP steels, because carbon is the most notorious element for lowering weldabiltiy and reducing it significantly improves the weldability. The C&P process also enhances the productivity, since the cooling process in the C&P process starts from relatively higher temperatures than conventional CFB production, whereas finally reaches as low temperatures as CFB. This means that bainitie formation can partially be accelerated due to relatively high temperatures at the initial stage of the cooling, which enhances productivity. At the same time, microstructures can be still sufficiently refined and austenite be stabilized at the final stage of the cooling process, where the temperature can be lowered to the same level as the conventional CFB TRIP steels.

In addition, the C&P process according to the invention also overcomes the drawbacks of the super bainite. FIG. 1B illustrates one type of super bainite steel production processes, which has a similar temperature path to the CFB process shown in FIG. 1D. The difference of the two processes is that, in the super bainite process, tempering is performed at a lower temperature. The super bainite process takes advantage of this lower temperature, which has a higher driving force for nucleation of bainite thus refines the microstructures. However, the super bainite must have high carbon content, to achieve low enough the $M_s$ temperature which allows low enough tempering temperature. The high carbon content leads to poor spot weldability and significantly restricts the application field of the steel alloy. In addition, the tempering process requires very long time, since the kinetics is slower at the lower temperatures. The C&P process of the invention improves both spot weldability and producibility, by applying the optimal cooling stage. Because of the carbon partitioning from bainitic ferrite to austenite, carbon atoms are effectively concentrated in austenite, which stabilizes austenite and decreases the $M_s$ temperature, as the cooling goes on. By utilizing this carbon partitioning, the carbon content of the steel alloy design can be significantly reduced. The producibility can be also improved by utilizing higher kinetics at higher temperatures at the beginning of the optimized cooling process.

In one aspect, the invention relates to a carbide-free bainite and retained austenite steel. In one embodiment, the carbide-free bainite and retained austenite steel includes a composition designed and processed such that the carbide-free bainite and retained austenite steel meets property objectives comprising a yield strength in a range of about 1000-2000 MPa, a uniform ductility, a desired total elongation and hole-expansion ratio, a desired level of weldability and an austenite stability designed to have an austenite start temperature $M_s^{\circ}$ to be equal to an application temperature in range from about 50° C. to −50° C. In one embodiment, the application temperature is about 5° C., or about −20° C. The property objectives are design specifications of the carbide-free bainite and retained austenite steel.

In certain embodiments, the desired total elongation and hole-expansion ratio and the desired level of weldability are determined based on the fields of applications of the carbide-free bainite and retained austenite steel, such as automotive industry, and aircraft industry.

In one embodiment, the composition is processed with a cooling and partitioning treatment.

In one embodiment, the composition comprises carbon (C) no more than 0.4 wt %, silicon (Si) no less than 1.0 wt %, and iron (Fe) in balance.

In one embodiment, the composition further comprises manganese (Mn) in a range of about 0.2-1.0 wt. %, and molybdenum (Mo) in a range of about 0.4-0.8 wt. %.

In one embodiment, the composition further comprises manganese (Mn) in a range of about 0.2-1.0 wt. %, and chromium (Cr) in a range of about 0.1-0.9 wt. %.

In one embodiment, the property objectives further comprises a carbon concentration in austenite, $C_\gamma$, in a range of about 1.0-1.8 wt. %.

In another aspect, the invention relates to a method for producing a carbide-free bainite and retained austenite steel.

Figure 3:
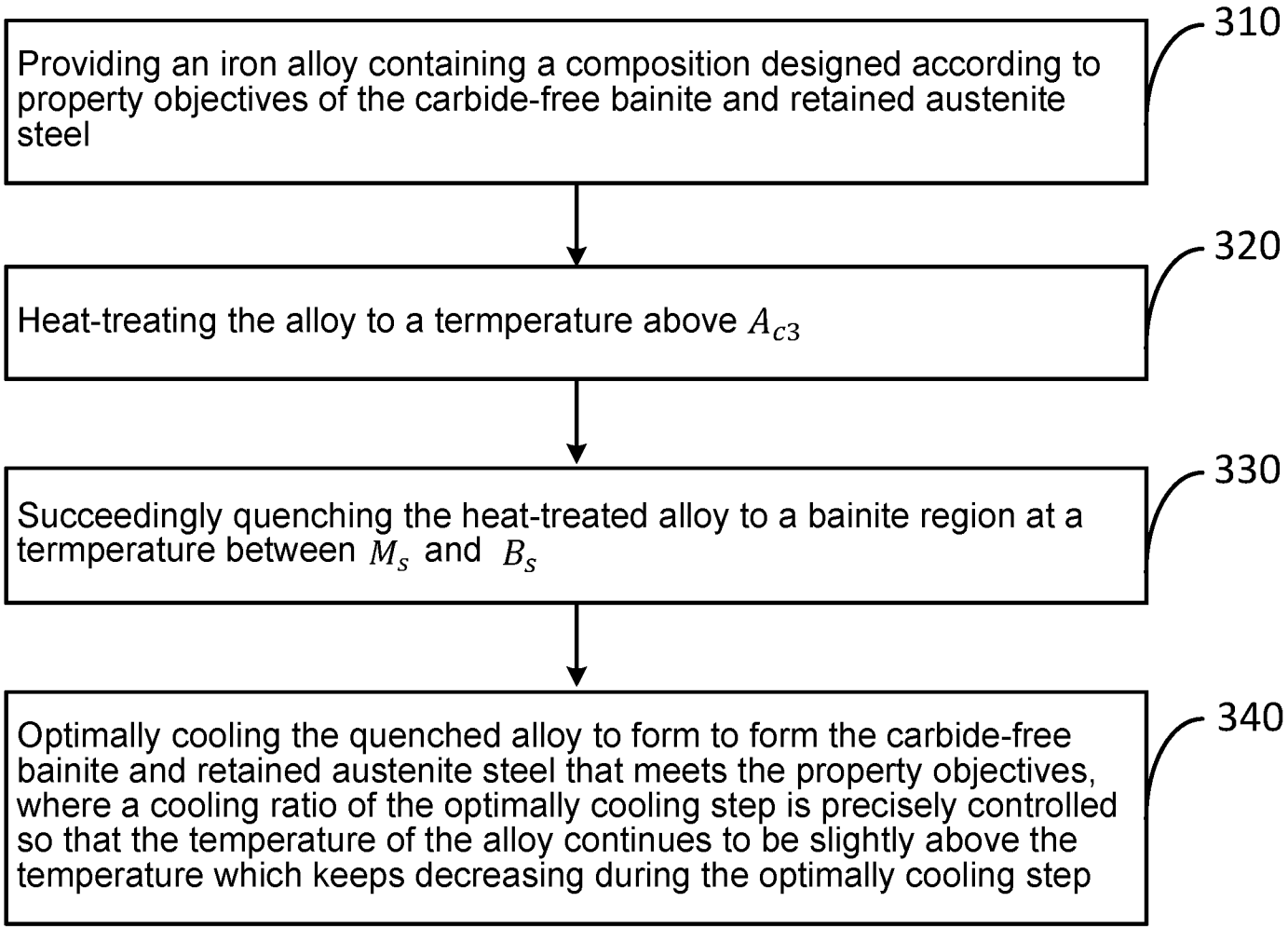
FIG. 3 shows a flow chart of the C&P process according to one embodiment of the invention.

Referring to FIG. 3, in one embodiment, the method includes providing an iron (Fe) alloy containing a composition designed according to property objectives of the carbide-free bainite and retained austenite steel, at step 310. The property objectives are design specifications of the carbide-free bainite and retained austenite steel.

The method also includes heat-treating the alloy to a temperature above $A_{c3}$, at step 320, where $A_{c3}$ is a temperature at which a transformation from ferrite into austenite is finished.

Furthermore, the method includes succeeding quenching the heat-treated alloy to a bainite region at a temperature between $M_s$ and $B_s$, at step 330, where $M_s$ is a temperature at which a martensitic transformation starts in the alloy, and $B_s$ is a temperature at which a coupled diffusional/displacive bainitic transformation starts the alloy.

In addition, the method further includes optimally cooling the quenched alloy to form to form the carbide-free bainite and retained austenite steel that meets the property objectives, at step 340, where a cooling ratio of the optimally cooling step is precisely controlled so that the temperature of the alloy continues to be slightly above the $M_s$ temperature which keeps decreasing during the optimally cooling step.

In one embodiment, the heat-treating step is performed with an austenization or hot rolling treatment.

In one embodiment, the heat-treating step is performed with a hot rolling treatment and subsequently a cold rolling treatment and a solution treatment.

In one embodiment, the optimally cooling step is performed with gradually cooling or step-wise cooling.

In one embodiment, the property objectives comprises a yield strength in a range of about 1000-2000 MPa, a uniform ductility, a desired total elongation and hole-expansion ratio, a desired level of weldability and an austenite stability designed to have an austenite start temperature $M_s^{\circ}$ to be equal to an application temperature in range from about 50° C. to −50° C. In one embodiment, the application temperature is about 5° C., or about −20° C.

In certain embodiments, the desired total elongation and hole-expansion ratio and the desired level of weldability are determined based on the fields of applications of the carbide-free bainite and retained austenite steel.

In one embodiment, the composition comprises carbon (C) no more than 0.4 wt %, silicon (Si) no less than 1.0 wt %, and iron (Fe) in balance.

In one embodiment, the composition further comprises manganese (Mn) in a range of about 0.2-1.0 wt. %, and molybdenum (Mo) in a range of about 0.4-0.8 wt. %.

In one embodiment, the composition further comprises manganese (Mn) in a range of about 0.2-1.0 wt. %, and chromium (Cr) in a range of about 0.1-0.9 wt. %.

In yet another aspect, the invention relates to a method for designing a carbide-free bainite and retained austenite steel. In one embodiment, the method includes defining property objectives of the carbide-free bainite and retained austenite steel, wherein the property objectives are design specifications of the carbide-free bainite and retained austenite steel; designing a composition of the carbide-free bainite and retained austenite steel according to the property objectives; and processing the composition to form the carbide-free bainite and retained austenite steel that meets the property objectives, wherein the processing step is performed with a cooling and partitioning process.

In one embodiment, the processing step comprises solidifying the composition to form an alloy; and reheating the alloy.

In one embodiment, the cooling and partitioning process comprises heat-treating the alloy to a temperature above $A_{c3}$, where $A_{c3}$ is a temperature at which a transformation from ferrite into austenite is finished; succeeding quenching the heat-treated alloy to a bainite region at a temperature between $M_s$ and $B_s$, wherein $M_s$ is a temperature at which a martensitic transformation starts in the alloy, and $B_s$ is a temperature at which a coupled diffusional/displacive bainitic transformation starts the alloy; and optimally cooling the quenched alloy to form to form the carbide-free bainite and retained austenite steel that meets the property objectives, wherein a cooling ratio of the optimally cooling step is precisely controlled so that the temperature of the alloy continues to be slightly above the $M_s$ temperature which keeps decreasing during the optimally cooling step.

In one embodiment, the heat-treating step is performed with an austenization or hot rolling treatment.

In one embodiment, the heat-treating step is performed with a hot rolling treatment and subsequently a cold rolling treatment and a solution treatment.

In one embodiment, the optimally cooling step is performed with gradually cooling or step-wise cooling.

In one embodiment, the composition comprises carbon (C) no more than 0.4 wt %, silicon (Si) no less than 1.0 wt %, and iron (Fe) in balance.

In a further aspect, the invention relates to a method for designing a carbide-free bainite and retained austenite steel. In one embodiment, the method includes determining a composition, and producing a trial alloy from the trial composition, wherein the trial alloy has substantially high hardenability to avoid formation of ferrite, and contains carbon no more than 0.4 wt % for weldability and silicon no less than 1.0 wt % for carbide prohibition; performing a cooling and partitioning treatment to the trial alloy, and experimentally evaluating the trial alloy at an initial state, a transitional path, and an end state of the cooling and partitioning treatment to obtain trial parameters comprising at least a quenching temperature, a descent of a $M_s$ temperature, and a final partitioning temperature; refining the composition by computational material engineering models using the trial parameters, such that an alloy formed of the refined composition meets property objectives of the carbide-free bainite and retained austenite steel, wherein the property objectives are design specifications of the carbide-free bainite and retained austenite steel.

In one embodiment, at the initial state, $M_s$ temperature, $B_s$ temperature used to identify a quenching temperature, and a bainite start time at different temperatures are measured; at the transitional path, the $M_s$ temperature is measured at different process times so as to determine a descent of the $M_s$ temperature; and at the end state, a final partitioning temperature, mechanical performance, austenite stability, and microstructures are measured.

In one embodiment, the cooling and partitioning treatment comprises heat-treating the alloy to a temperature above $A_{c3}$, where $A_{c3}$ is a temperature at which a transformation from ferrite into austenite is finished; succeeding quenching the heat-treated alloy to a bainite region at a temperature between $M_s$ and $B_s$, wherein $M_s$ is a temperature at which a martensitic transformation starts in the alloy, and $B_s$ is a temperature at which a coupled diffusional/displacive bainitic transformation starts the alloy; and optimally cooling the quenched alloy to form to form the carbide-free bainite and retained austenite steel that meets the property objectives, wherein a cooling ratio of the optimally cooling step is precisely controlled so that the temperature of the alloy continues to be slightly above the $M_s$ temperature which keeps decreasing during the optimally cooling step.

In one embodiment, the optimally cooling step is performed with gradually cooling or step-wise cooling.

These and other aspects of the present invention are further described below. Without intent to limit the scope of the invention, examples according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Trial Design

In one embodiment, the trial (initial) design initiated from deciding the trial composition for the C&P treatment, and producing the test samples. In this exemplary example, the trial alloy has high enough hardenability to avoid formation of ferrite, contains no more carbon than 0.4 wt % for weldability and no less silicon than 1.0 wt % for carbide prohibition. Two different samples were produced by hot-rolling or cold-rolling succeeded by hot-rolling from Nippon Steel & Sumitomo Metal Corp. Table 1 shows the composition of the initial design. Mn and Mo was added to provide sufficient hardenability to avoid formation of ferrite in the initial quenching.

TABLE 1

Chemical composition of the trial design

| | C [wt %] | Si [wt %] | Mn [wt %] | Mo [wt %] | Fe [wt %] |
|---|---|---|---|---|---|
| Designed | 0.25 | 1.00 | 0.50 | 0.60 | (balance) |
| Produced | 0.25 | 1.00 | 0.48 | 0.61 | (balance) |

Experimental Evaluation

Figure 6B:
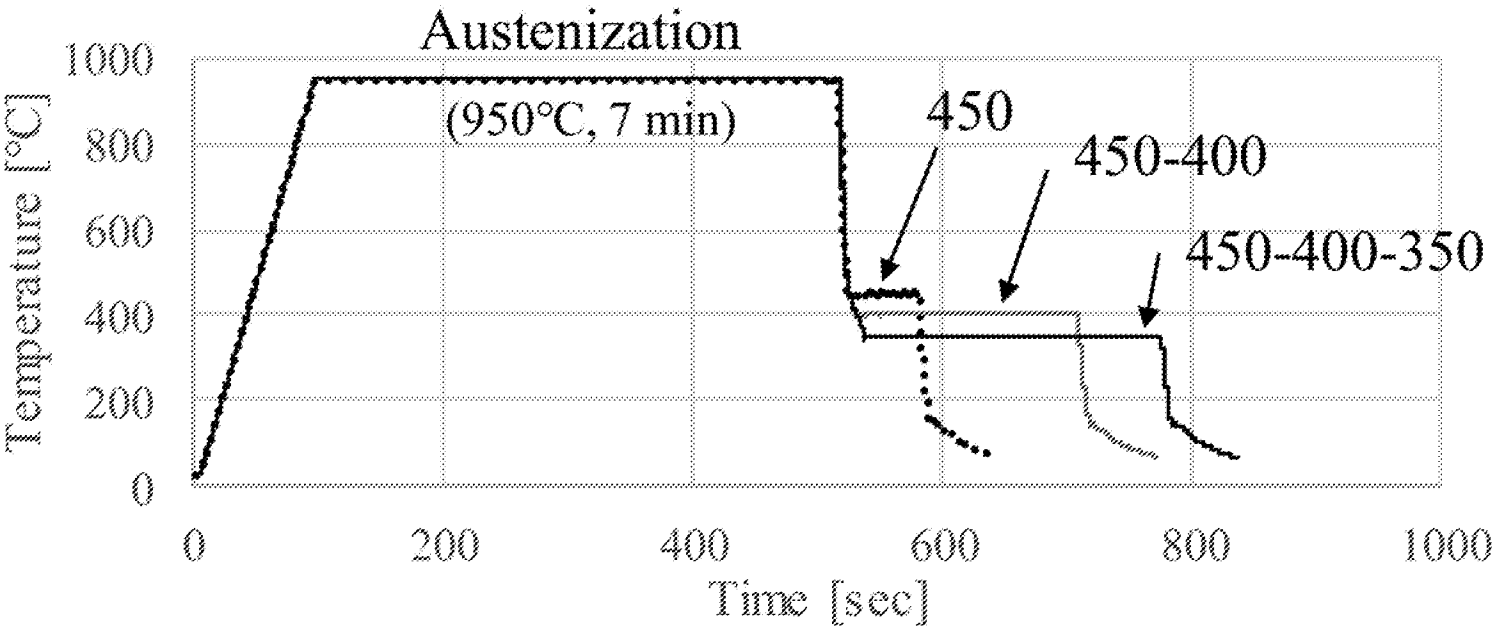
FIGS. 6B-6C show the performed C&P treatment for trial samples of (FIG. 6B) initial quenching to 450° C., and (FIG. 6C) initial quenching to 520° C., according to embodiments of the invention.
Figure 6C:
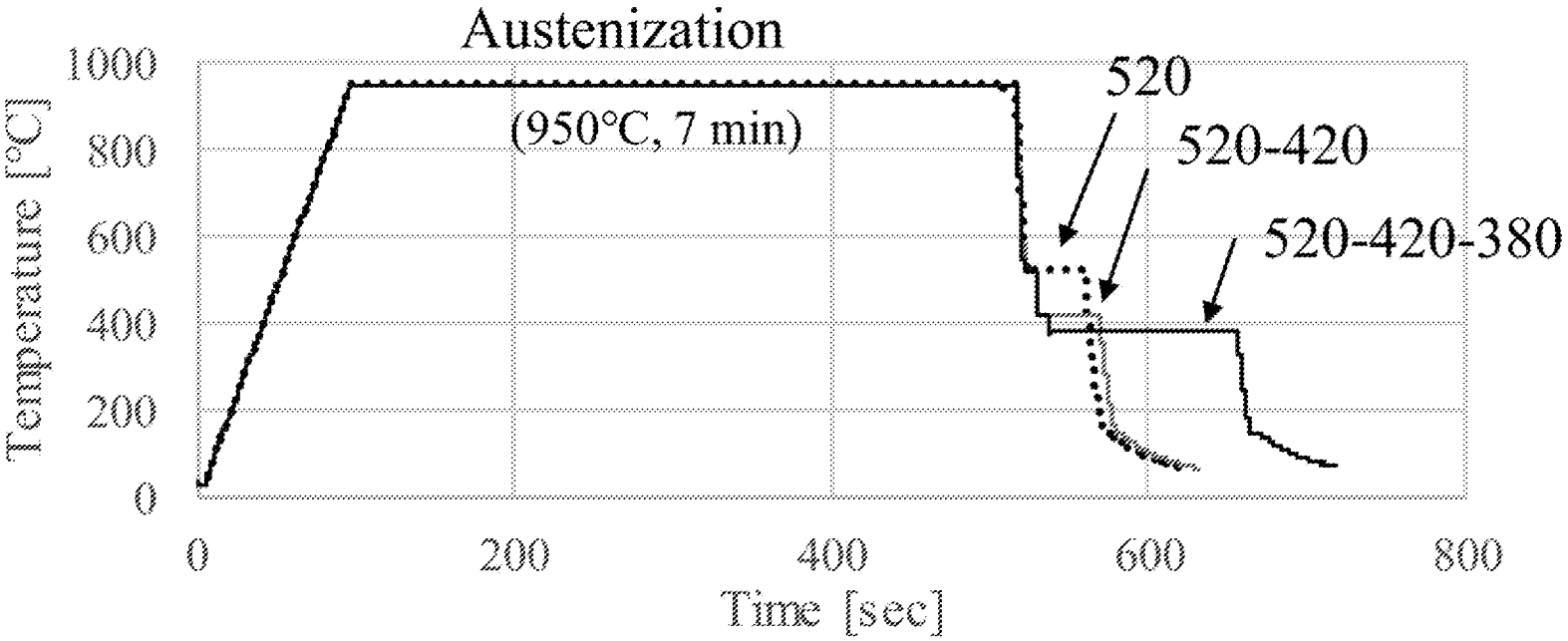

Heat Treatment:—The C&P treatment was performed for the produced trial samples using Gleeble 3400 (Dynamic Systems Inc., Poestenkill, NY), where dilatation data was obtained during the heat-treatment, in order to experimentally validate the C&P process. Tables 2 and 3 and FIGS. 6B-6C summarize the performed heat-treatments. In order for the post-process analysis to be easily understandable, the simplified step-wise cooling was performed instead of gradual cooling. Two different quench temperatures (450° C. and 520° C.), after which step-wise cooling initiates, were tried out to identify the effect of the quench temperature. After quenching to either 450° C. or 520° C., sample was further heat-treated in either 1-, 2- or 3-step cooling. Samples with increased number of steps of cooling lead to a lower final partitioning temperature, thus have a lower $M_s$ temperature, and finer microstructures. Partitioning temperature at each step was decided due to the experimentally measured $M_s$ temperature, which decreases as partitioning goes. In particular, the partitioning temperature at each cooling step was designed to be 20° C. to 30° C. higher than the measured $M_s$ temperature measured at the beginning of that partitioning step. Partitioning time at each cooling step, on the other hand, was determined by the experimentally measured bainite kinetics. The partitioning time is designed so that half of the remaining austenite at the beginning of partitioning transforms to bainite at the end of the cooling step.

TABLE 2

Performed the C&P treatment for the samples of initial quench to 450° C.

| | 1st Step | | 2nd Step | | 3rd Step | |
|---|---|---|---|---|---|---|
| Sample Name | Temp. [° C.] | Time [sec] | Temp. [° C.] | Time [sec] | Temp. [° C.] | Time [sec] |
| 450 | 450 | 60 | | | | |
| 450-400 | 450 | 6 | 400 | 180 | | |
| 450-400-350 | 450 | 6 | 400 | 6 | 350 | 240 |

TABLE 3

| Performed the C&P treatment for the samples of initial quench to 520° C. | | | | | | |
|---|---|---|---|---|---|---|
| | 1st Step | | 2nd Step | | 3rd Step | |
| Sample Name | Temp. [° C.] | Time [sec] | Temp. [° C.] | Time [sec] | Temp. [° C.] | Time [sec] |
| 520 | 520 | 40 | | | | |
| 520-420 | 520 | 7 | 420 | 40 | | |
| 520-420-380 | 520 | 7 | 420 | 5 | 380 | 120 |

Figure 7A:
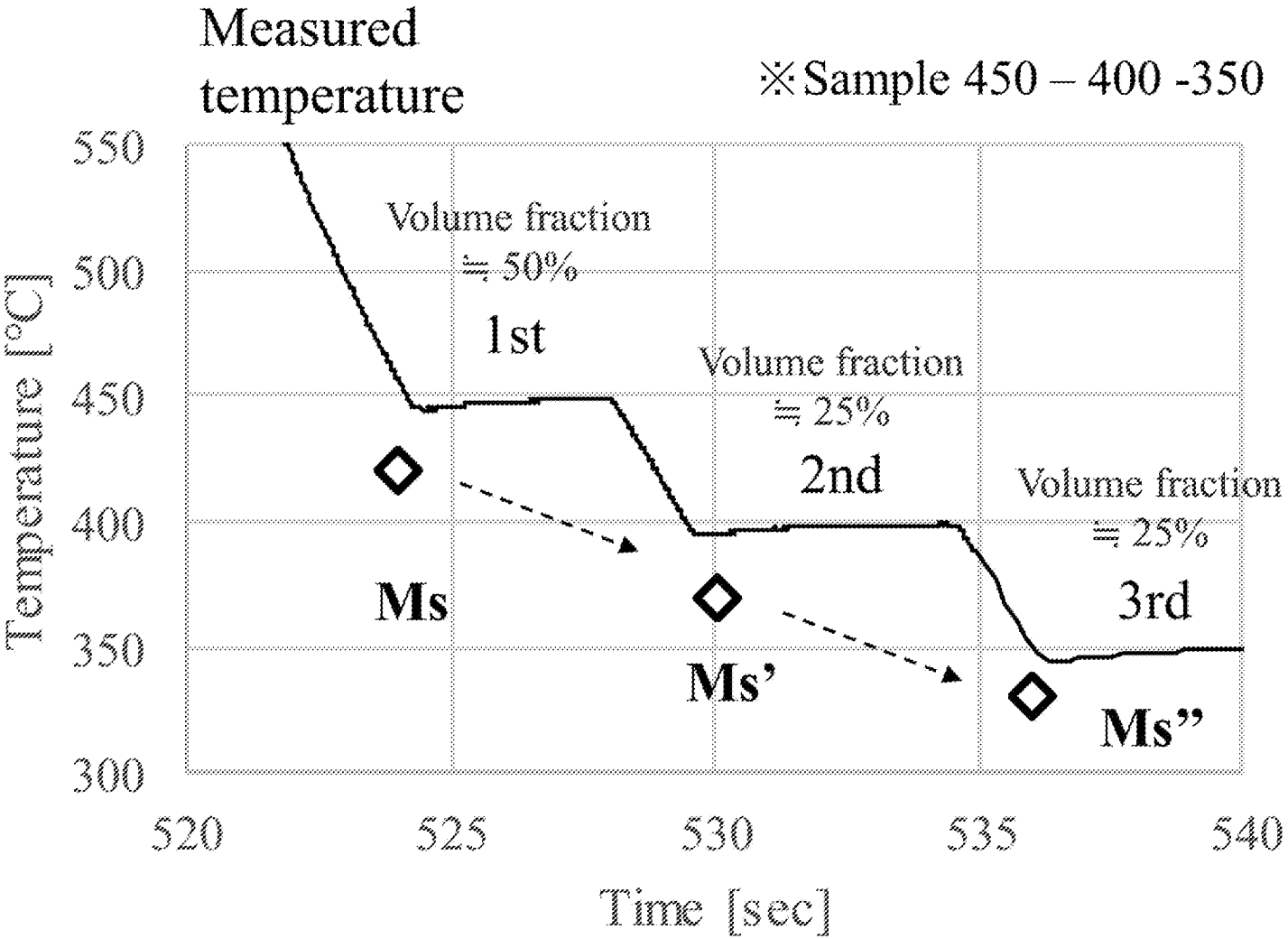
FIGS. 7A-7B show the $M_s$ temperatures after each partitioning step as well as the heat-treatment for 3-step cooling for the samples of (FIG. 7A) initial quenching to 450° C., and (FIG. 7B) initialing quench to 520° C., according to embodiments of the invention.
Figure 7B:
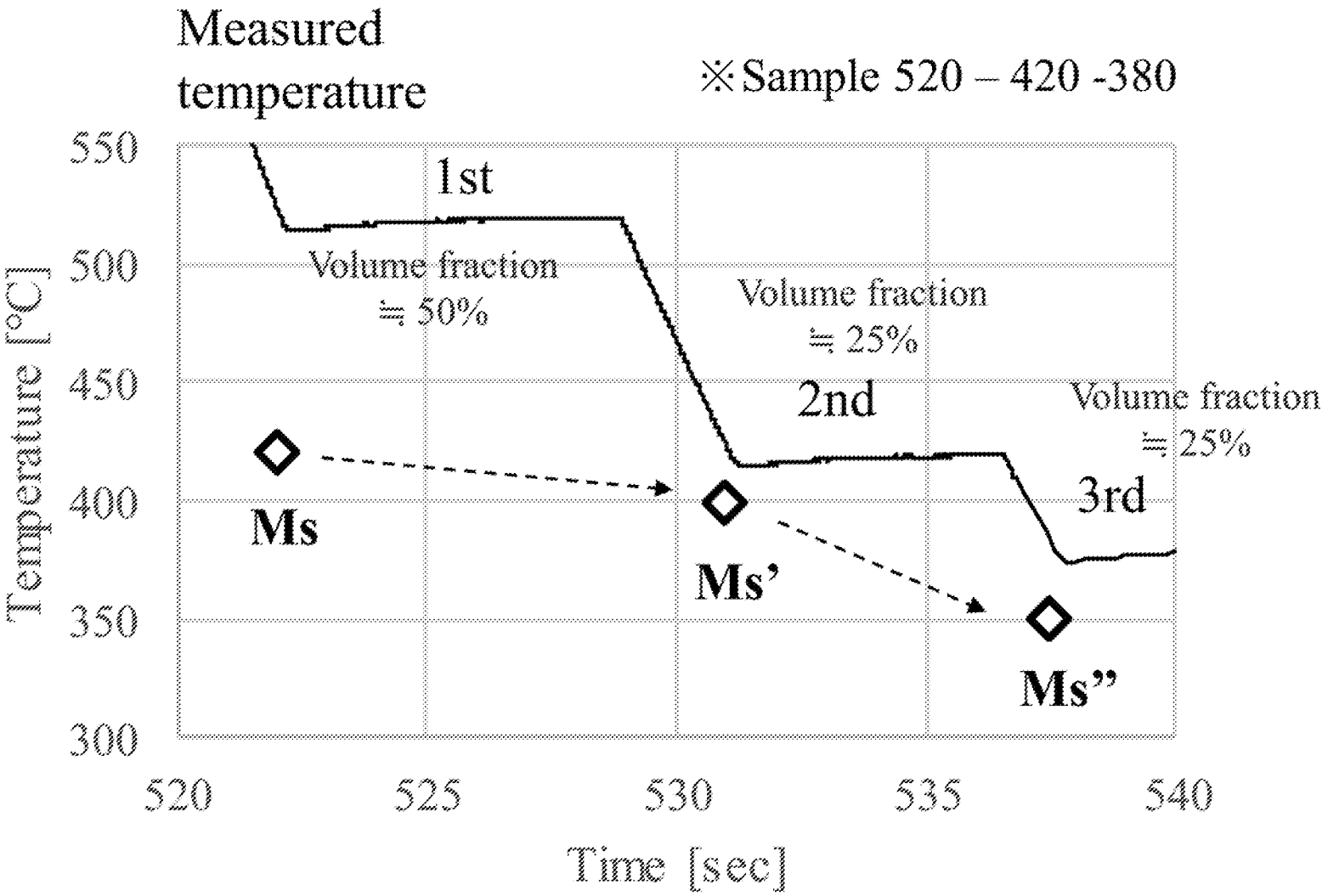
Figure 8:
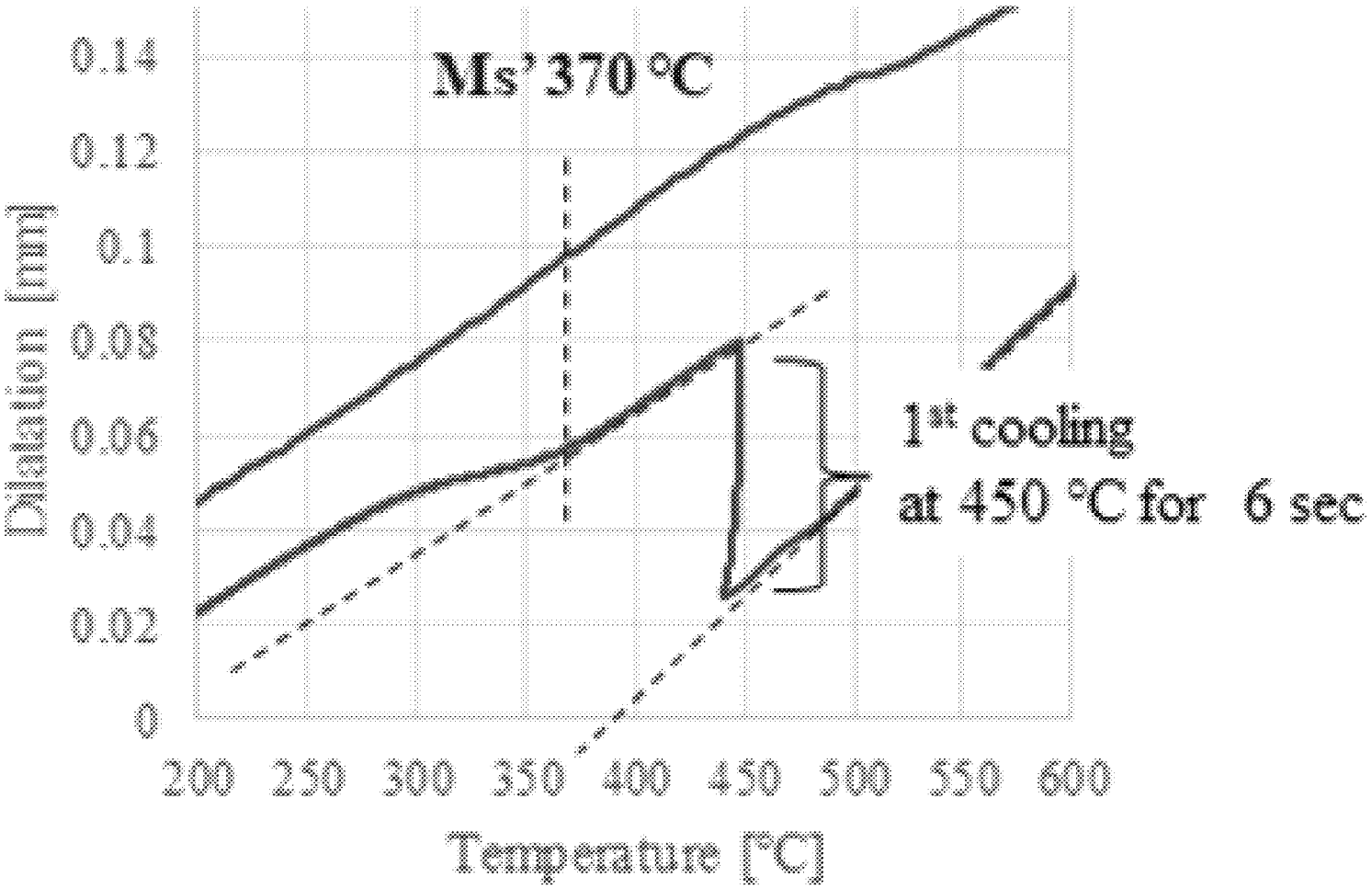
FIG. 8 shows the $M_s$ temperature determination from dilatation data from the sample quenched right after first cooling at 450° C. according to one embodiment of the invention.
Figure 9:
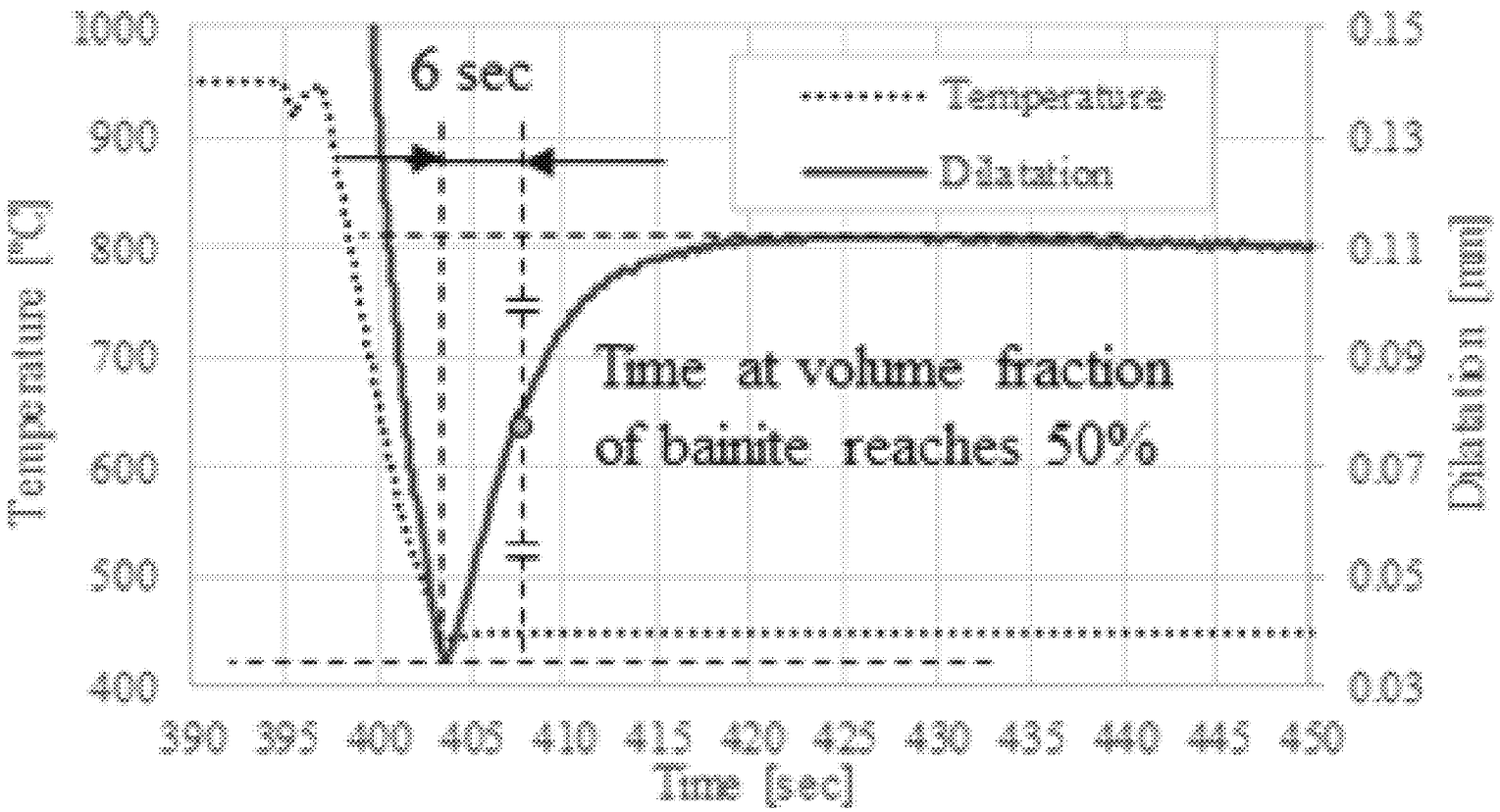
FIG. 9 shows determination of holding time at first cooling step at 450° C. by fully bainite formation experiment at 450° C., according to one embodiment of the invention.

Descent of the $M_s$ Temperature: FIGS. 7A-7B show the experimentally determined $M_s$ temperatures at different partitioning steps, which were obtained by quenching to room temperature at the timing of interest in the middle of the partitioning process in step-wise C&P experiments. For instance, in order to measure the $M_s$ temperature after the first cooling step at 450° C., the sample was quenched to room temperature right after the first cooling step is completed, thereafter its dilatation data was examined to find the $M_s$ temperature, as illustrated in FIG. 8. Partitioning time at each step was determined so that half of the remaining austenite transforms into bainite. This was determined by a separate experiment where fully bainite formation at the step of interest is performed, and by analyzing the required time for half-completion of bainite. FIG. 9 illustrates an example for determination of the holding time at 400° C. after quenching to 450° C., where the time for half bainite completion was measured to be 6 seconds. From this observation, the holding time at the first step has been determined to 7 seconds for 2- or 3-step C&P treatment. FIGS. 7A-7B clearly show that the $M_s$ temperature decreases during the partitioning stage, which supports the mechanism of the C&P process.

Figure 11B:
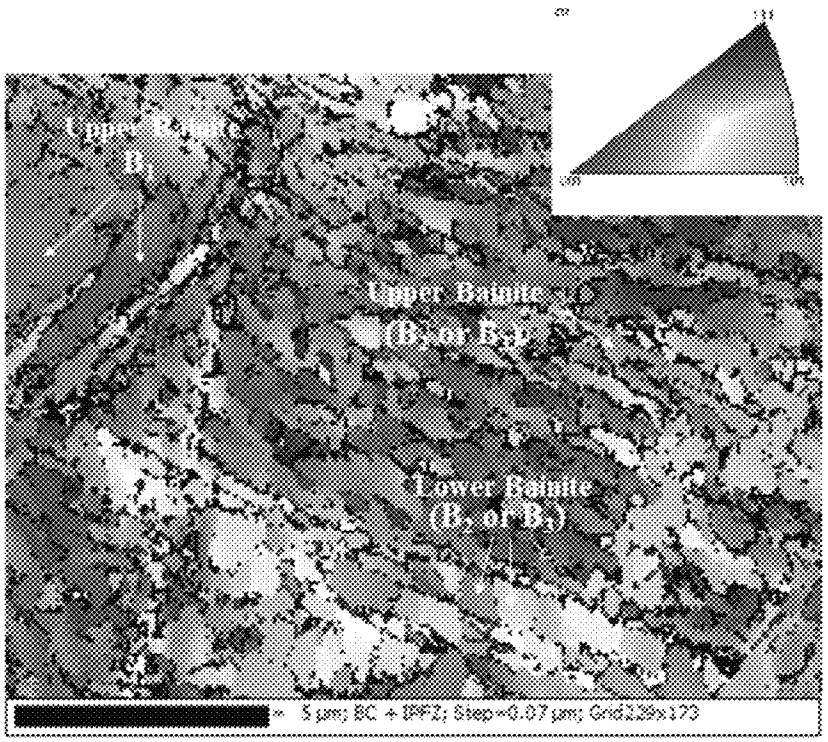
FIGS. 11A-11B show EBSD analysis of sample 450-400-350.
Figure 11A:
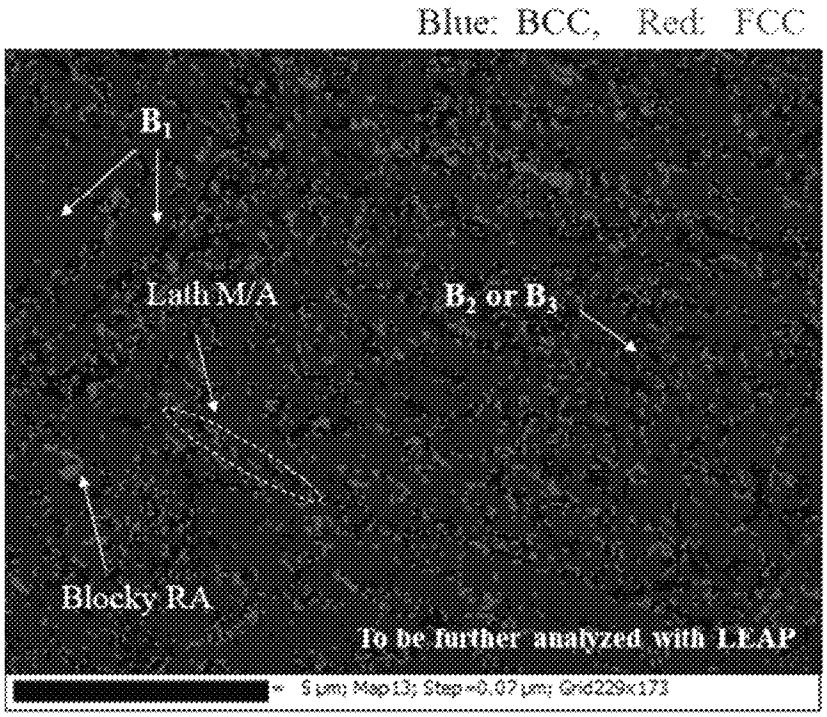

Microstructure Refinement: FIGS. 10A-10F illustrate different microstructures from the samples after six different C&P heat-treatments. The images were obtained from SEM analysis after initial-etching. It can be seen that the microstructure meaningfully refines along with bringing down the final partitioning temperature. As expected, as the final partitioning temperature is lowered, the finer microstructure becomes, and the lower quenching temperature leads to the finer microstructure. In the case of three-step heat-treatment after the initial quenching to 450° C., lath thickness of bainitic ferrite was found to be as thin as 70 nm. EBSD analysis was performed to identify an austenite position and morphologies as shown in FIGS. 11A-11B. It can be seen that austenite is finely distributed in the lath-shape, which is good for the mechanical performance compared to the blocky-shape, because of the enhanced stability of austenite due to its morphology.

Figure 12A:
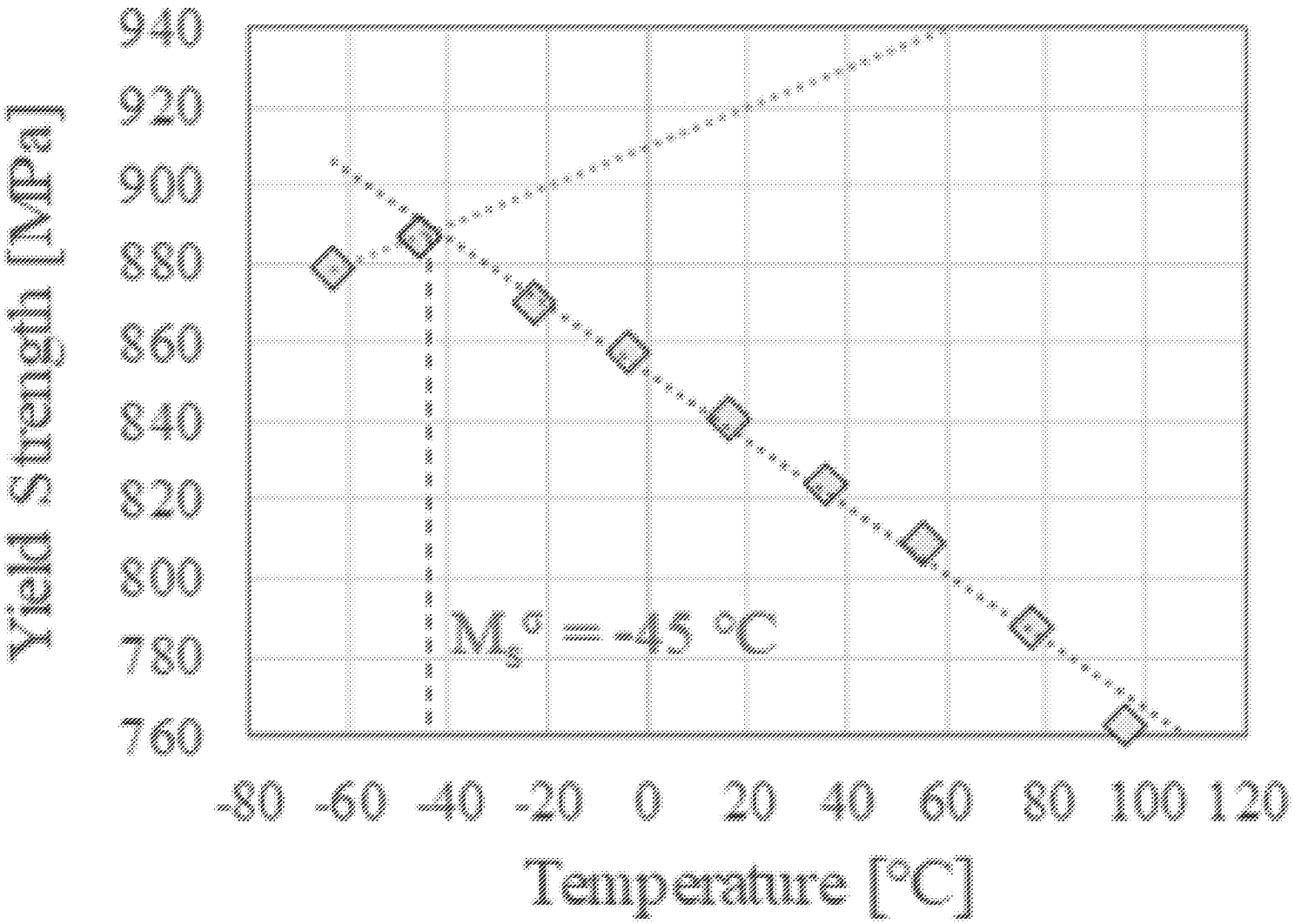
FIGS. 12A-12C show Bolling-Richman single specimen technique to identify $M_s^{\sigma}$ temperature for sample 450-400, according to embodiments of the invention.
Figure 12B:
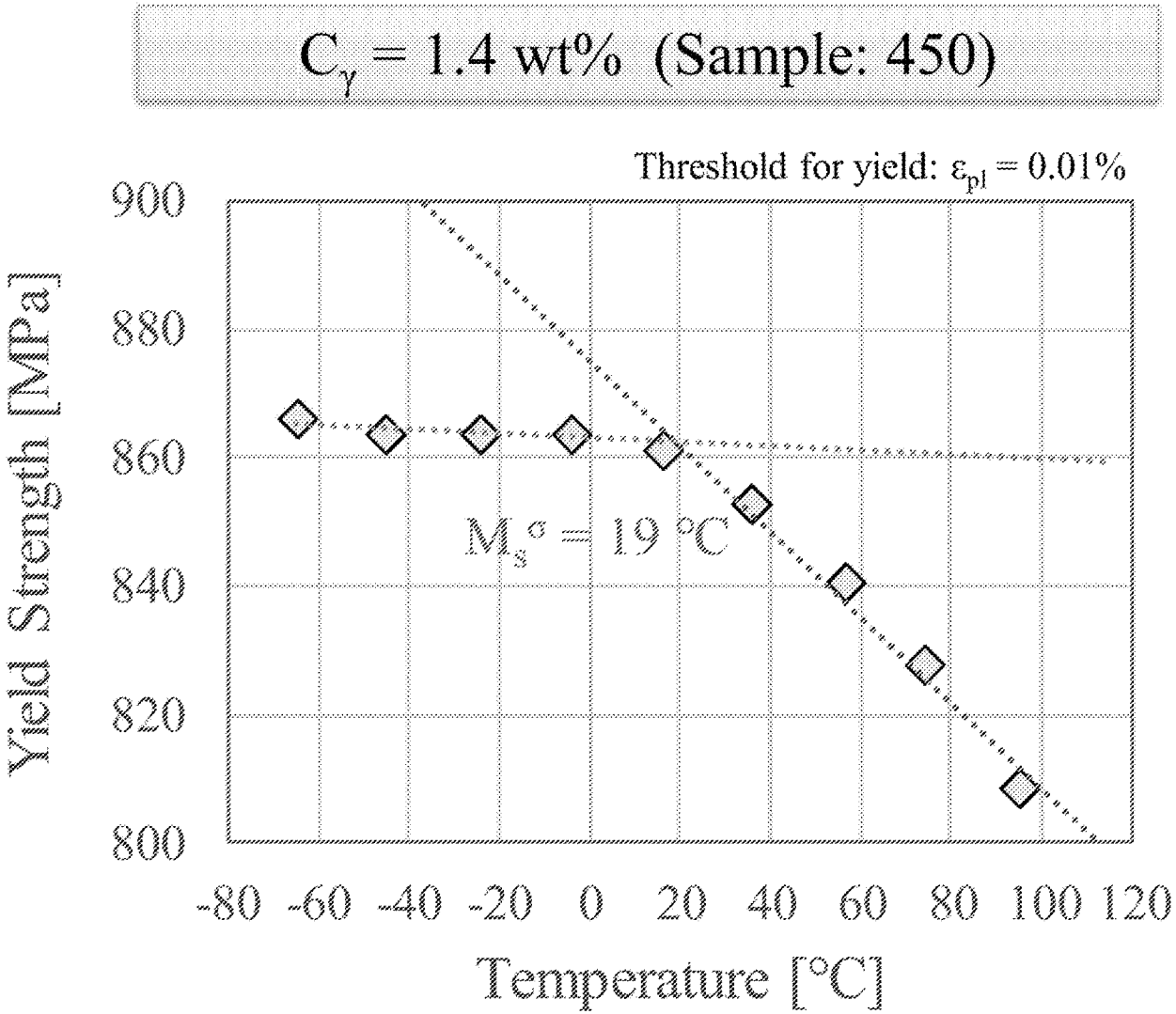
Figure 12C:
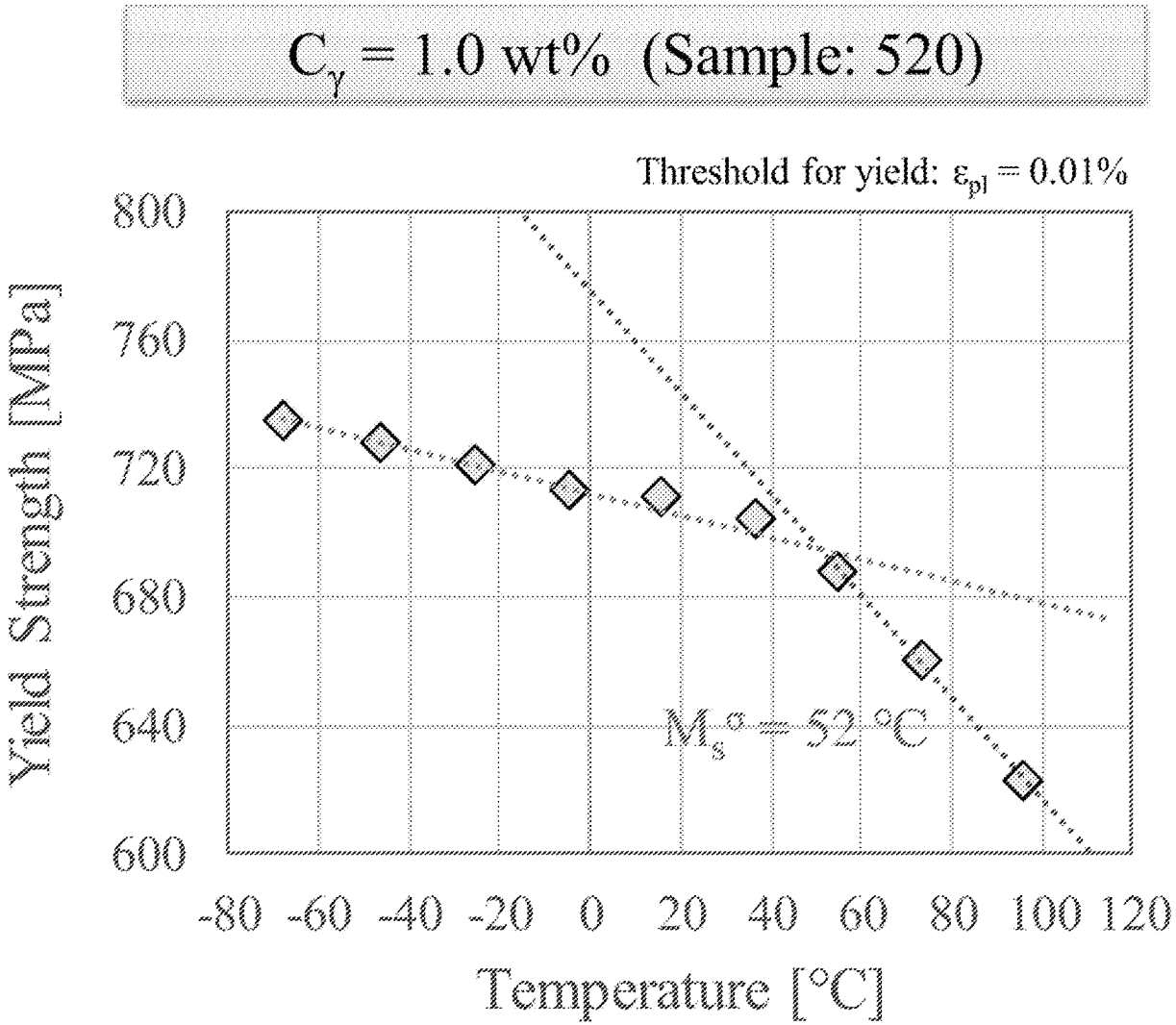

Mechanical Testing: Bolling-Richman single specimen technique was performed for the six samples after the C&P treatment described in Tables 2 and 3. FIGS. 12A-12C show three examples of Bolling-Richman test, from which the $M_s^o$ temperature is determined by looking at the temperature with the highest value of yield strength. The $M_s^o$ temperature was identified by Bolling-Richman single specimen technique. Lower partitioning temperature leads to higher austenite stability thus lower the $M_s^o$ temperature.

Figure 13A:
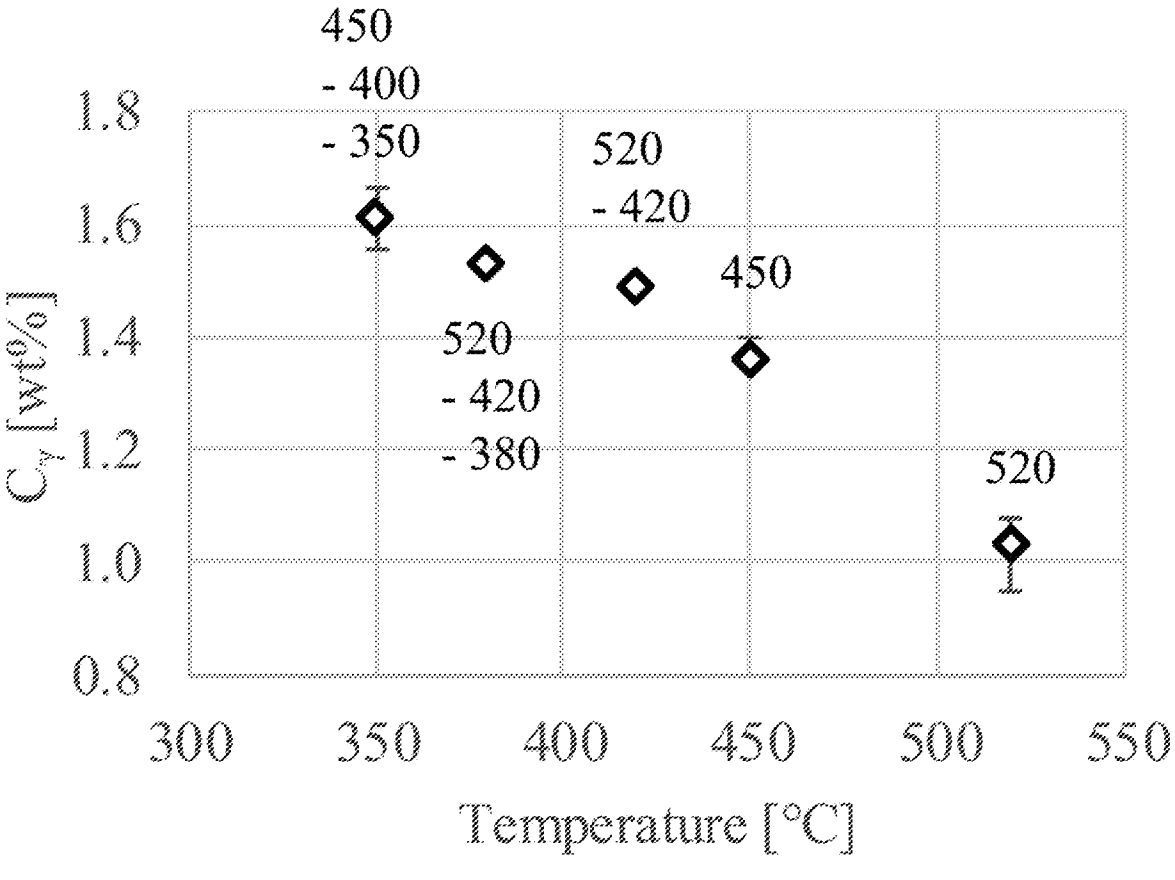
FIGS. 13A-13B show XRD analysis for the C&P treated samples.
Figure 13B:
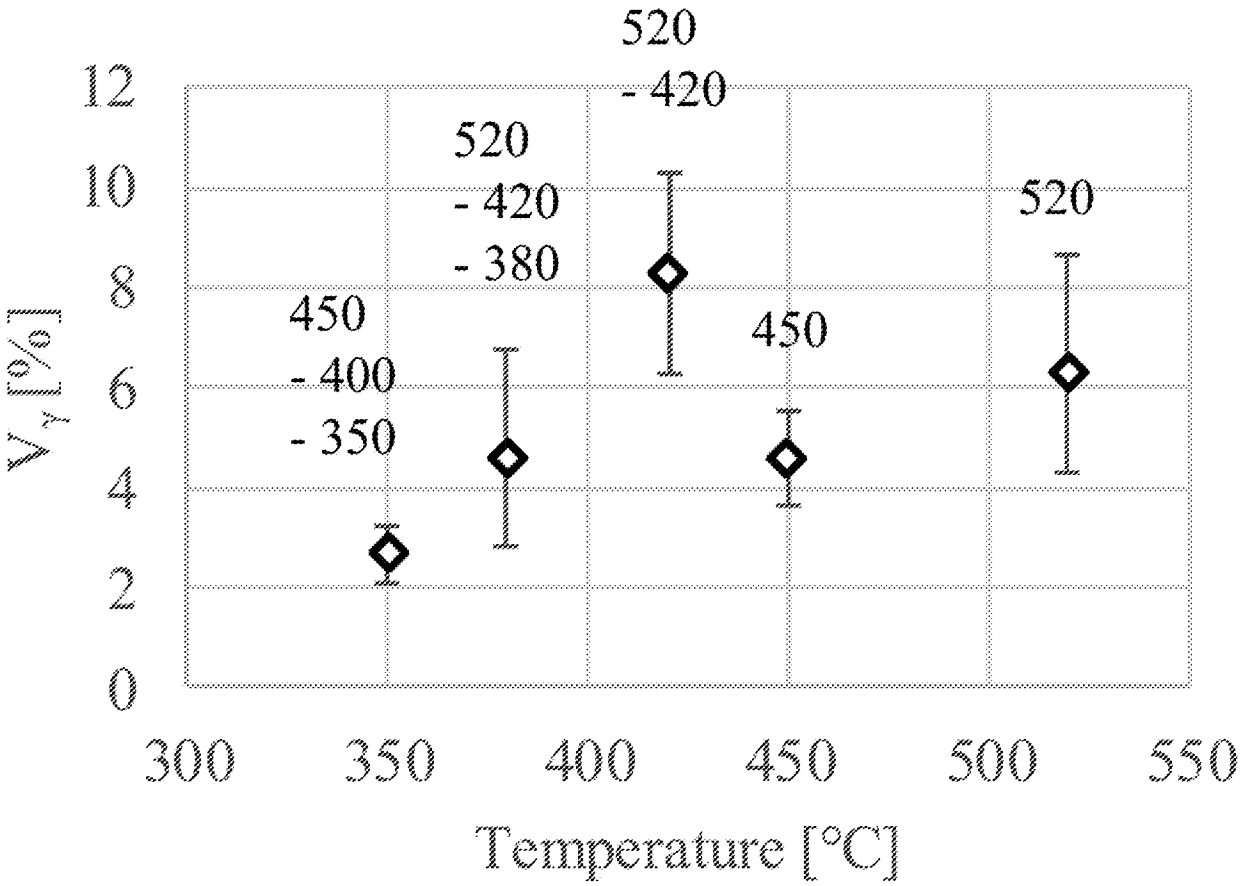

XRD Experiments: X-ray diffraction analysis was performed for the six samples after the C&P treatment listed in Tables 2 and 3. FIGS. 13A-13B show the carbon concentration and volume fraction of the retained austenite phase, determined by high energy X-ray diffraction (HEXRD) analysis. As the final partitioning temperature decreases, carbon enriches in austenite, thereby reducing the volume fraction of austenite due to a mass balance of carbon. The HEXRD experiments were also performed in Argonne National Laboratory, in order to analyze the carbon concentration and volume fraction of austenite in better accuracy.

Figure 14A:
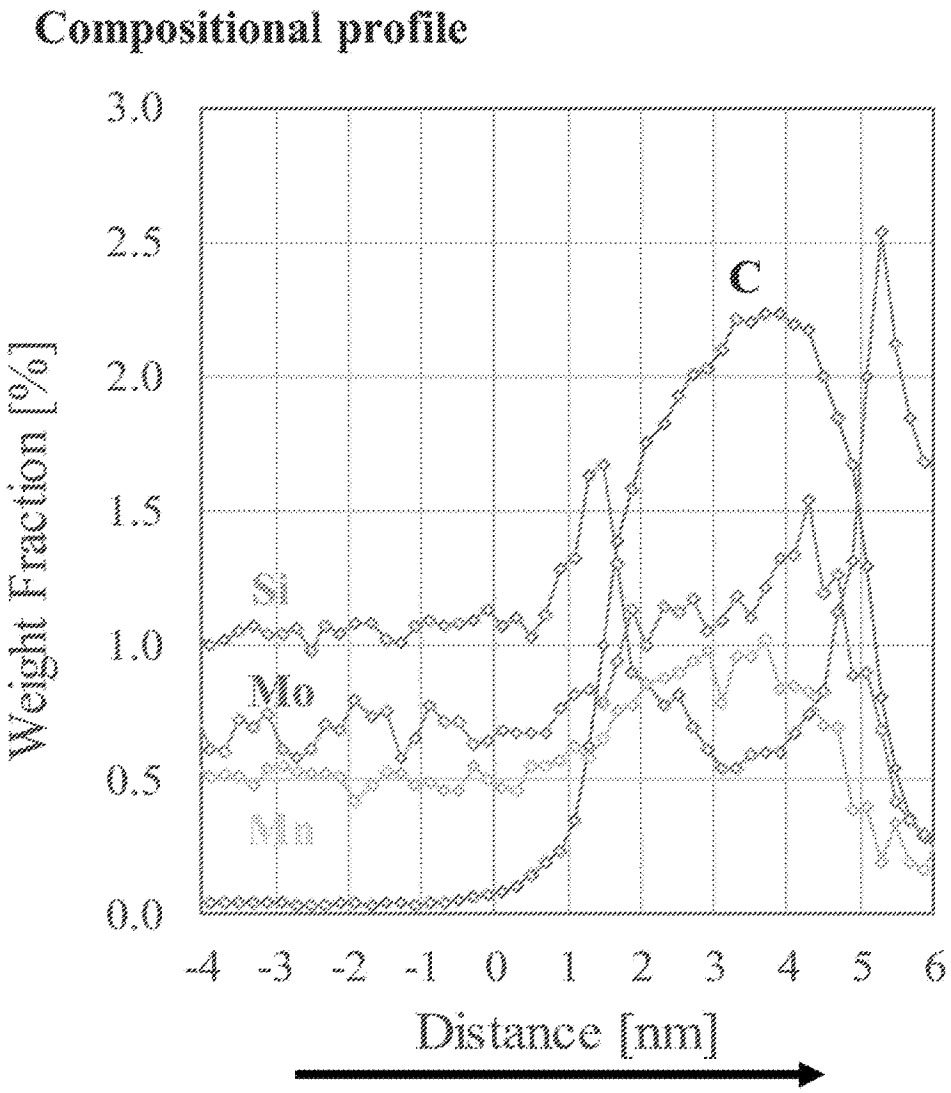
FIGS. 14A-14B show compositional profile (FIG. 14A) and carbon atom distribution (FIG. 14B) of a C&P treated sample, according to embodiments of the invention
Figure 14B:
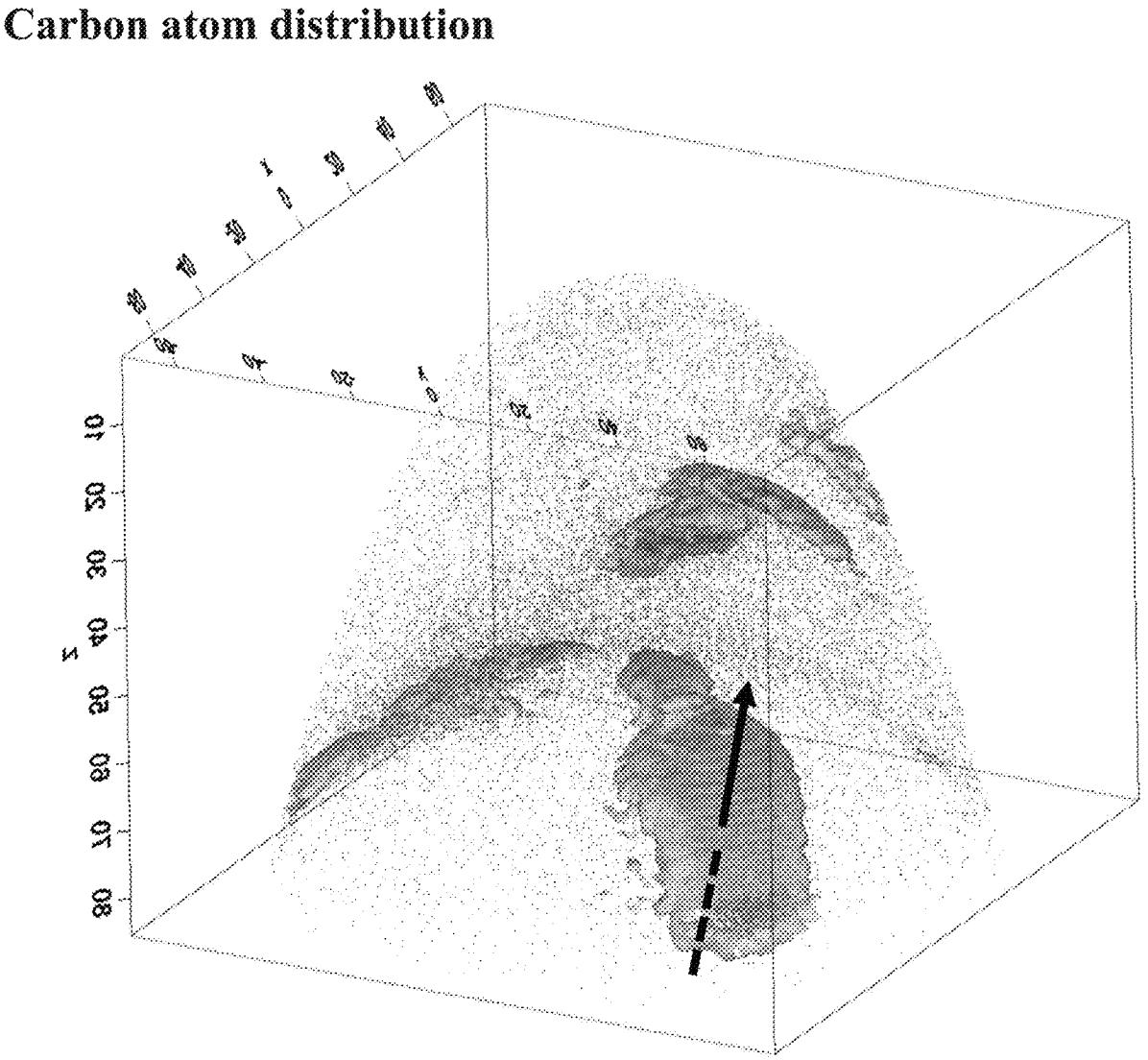

Local Electrode Atom Probe Tomography (LEAP): LEAP analysis shown in FIGS. 14A-14B was performed with LEAP 5000. Partitioning of substitutional elements observed at 450° C. as well as carbon. Further observations are ongoing for different temperatures and morphologies (lath thickness).

Computational Modeling

Figure 15A:
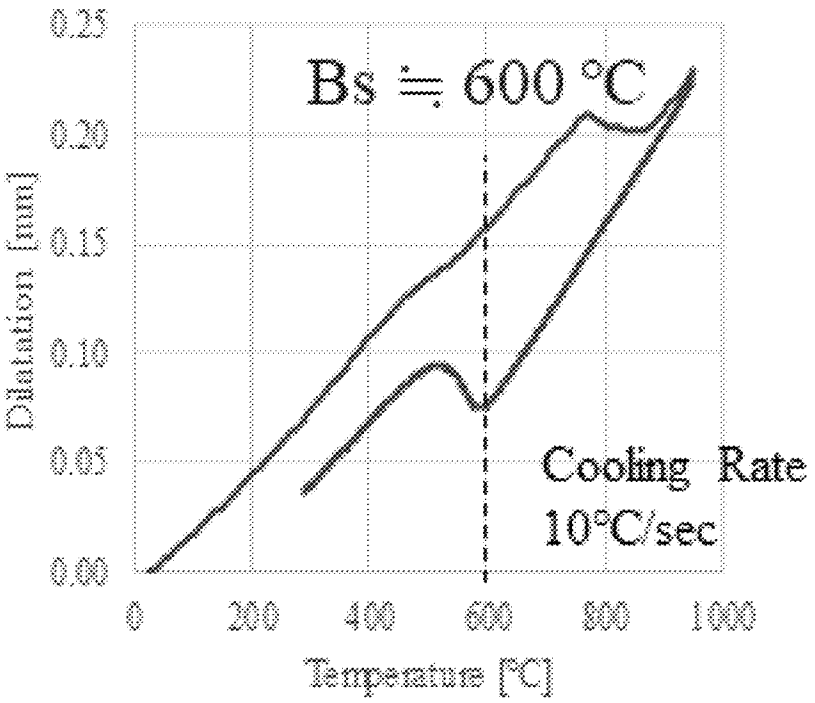
FIG. 15A-15C show experiments performed to determine TTT curve for the trial alloy.
Figure 15B:
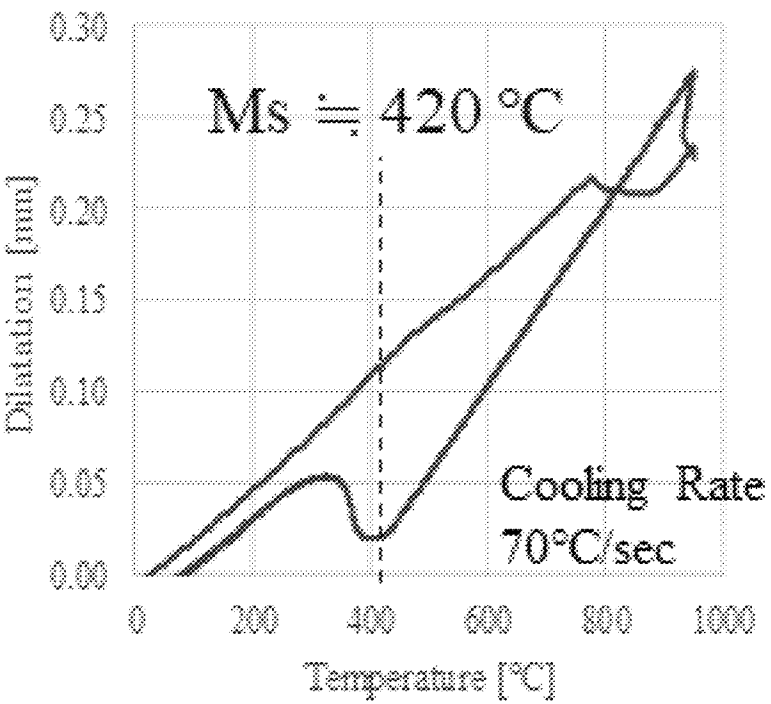
Figure 15C:
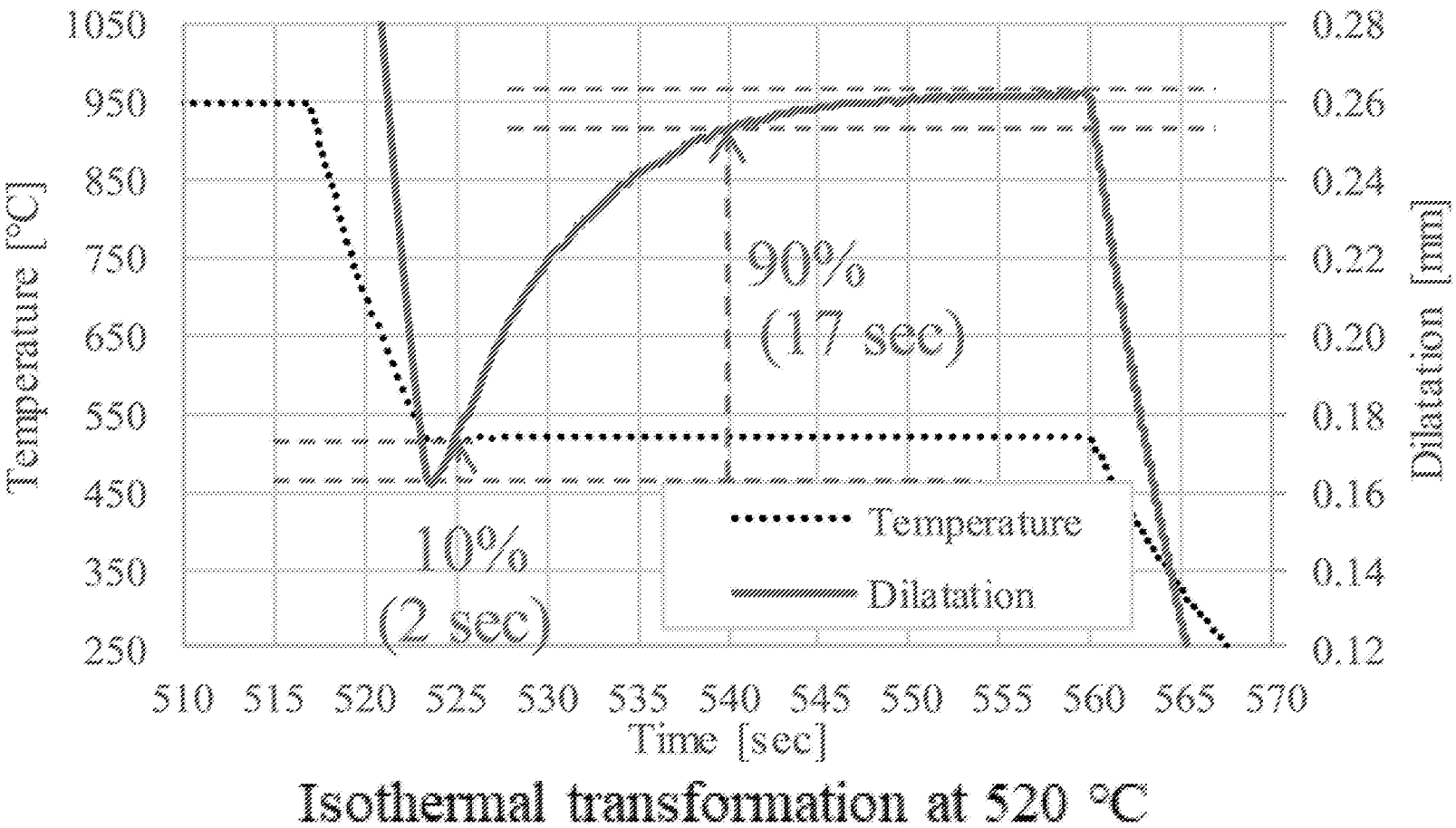
Figure 16B:
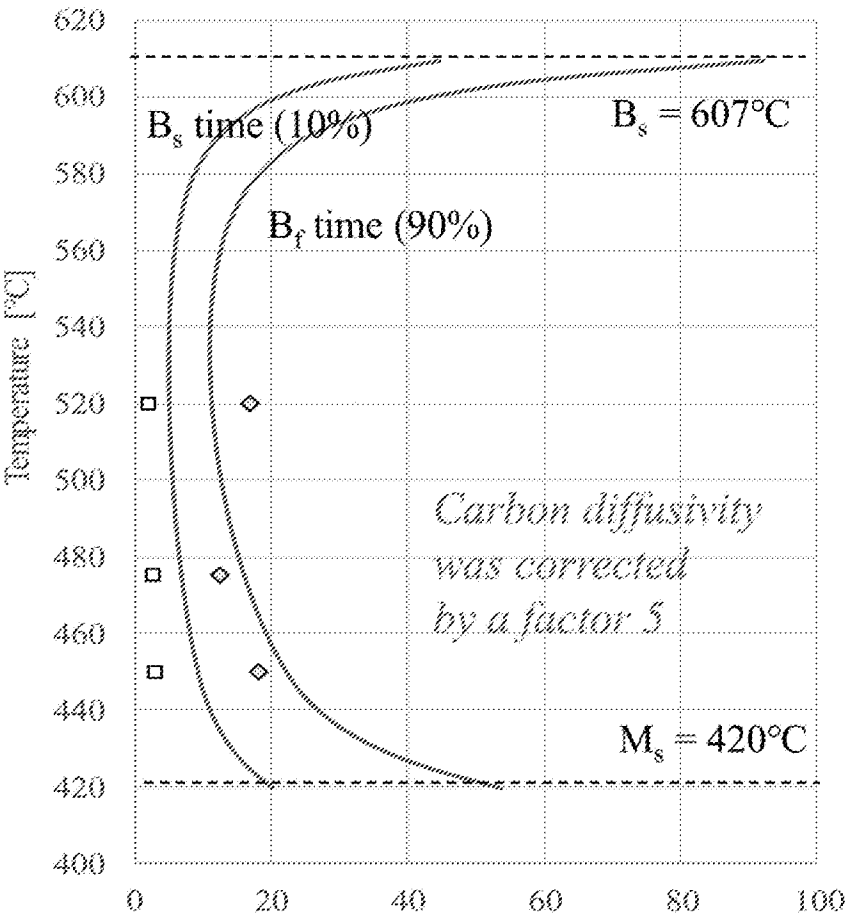
FIGS. 16A-16B show calculated TTT curve for the trial alloy, (FIG. 16A) without any calibration and (FIG. 16B) after calibration to experiments shown in FIGS. 15A-15C, according to embodiments of the invention.
Figure 16A:
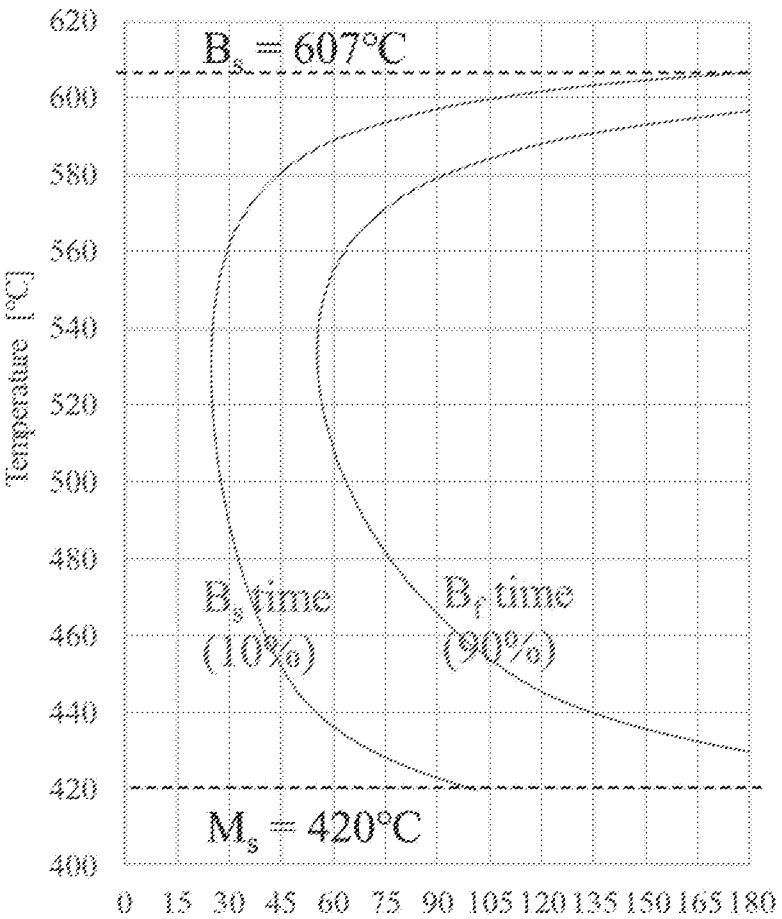

Prediction of Time-Temperature-Transformation (TTT) Curve: Fe-martbain model was calibrated with dilatometric experiments as shown in FIGS. 15A-15C and 16A-16B. Transformation temperatures, $M_s$ and $B_s$, were very accurate compared to the experimentally evaluated values without any calibration. FIGS. 15A and 15B illustrate the experimentally measured $B_s$ and $M_s$, which were determined to be 600° C. and 420° C., respectively. They match with the calculated values, within error of ±10° C., which are 607° C. and 420° C. as shown in FIG. 15A. Bainite kinetic model, on the other hand, originally showed discrepancies with experiments, but showed good agreement once calibrated. FIG. 15C illustrates the bainitic transformation kinetics when isothermal holding at 520° C. from the dilatometric experiment, from which one can obtain the transformation time required for the volume fraction of bainite reaches to 10% (bainite start time) and 90% (bainite finish time), as an example of how data for the TTT curve can be experimentally obtained. Fe-martain model initially calculated faster kinetics than experiment, hence the linear correction factor was applied to carbon diffusivity. Once calculated, the model proves reasonable agreement with experiment as depicted in FIG. 16B.

Figure 17:
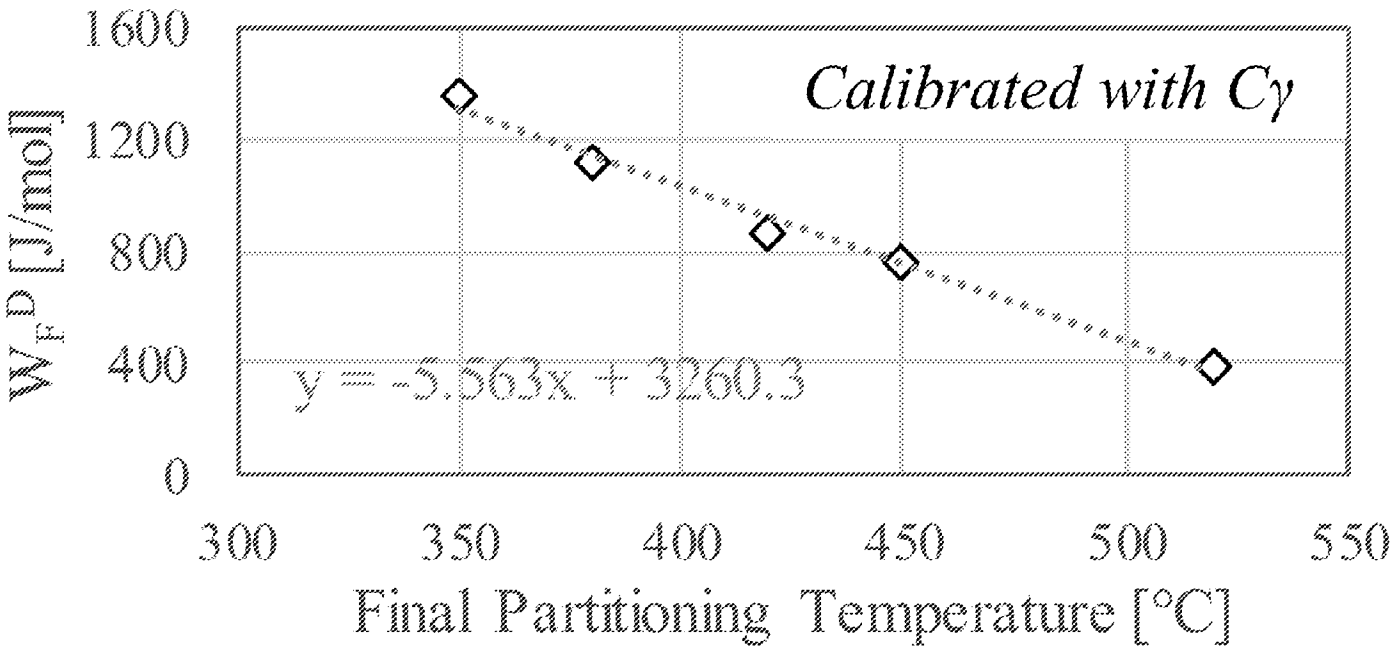
FIG. 17 shows experimentally determined effects of temperature on $W_f^D$ term on the effective stored energy model, according to embodiments of the invention.
Figure 18:
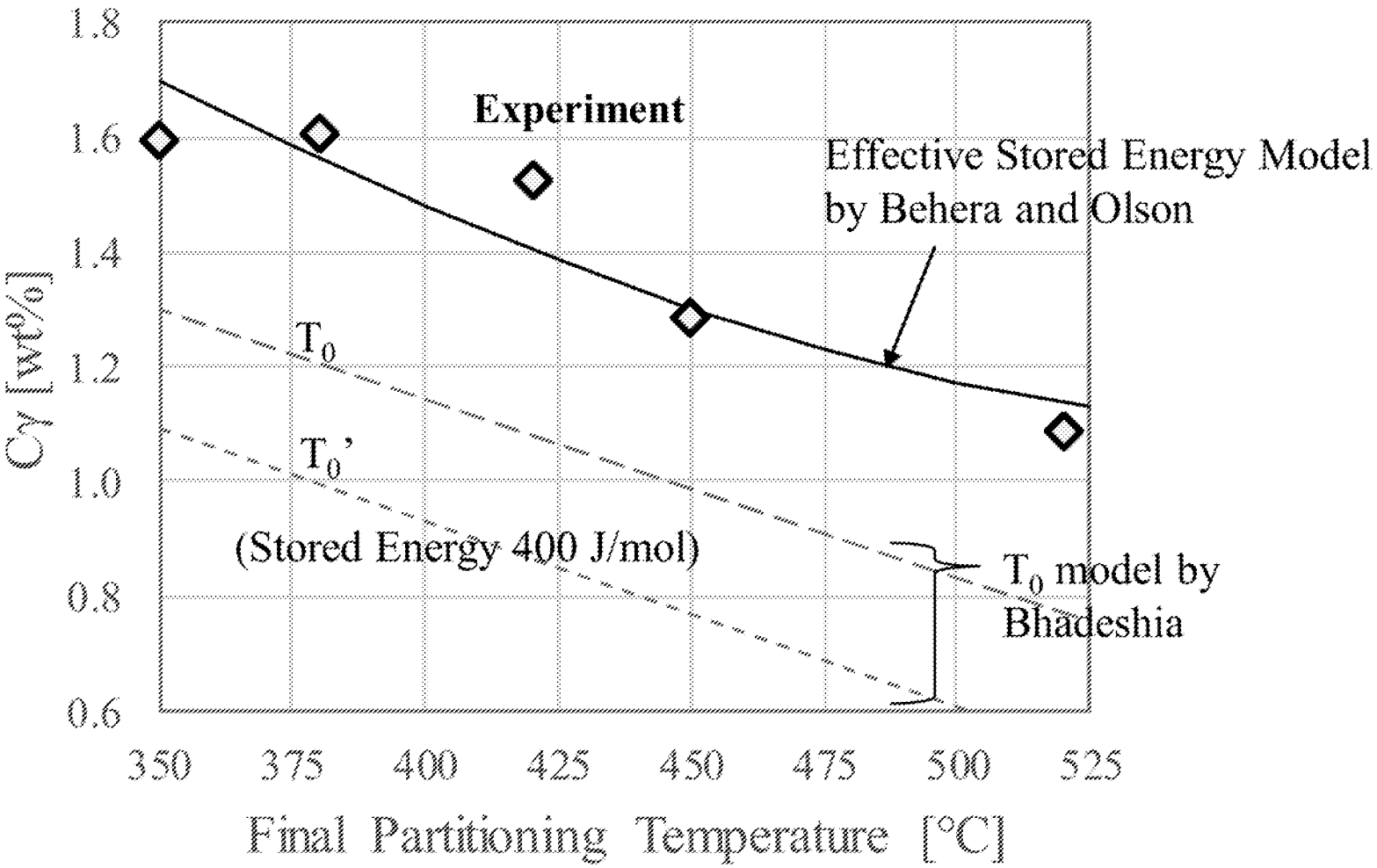
FIG. 18 shows Measured and predicted values of carbon concentration in retained austenite phase, according to embodiments of the invention.

Prediction of Carbon Concentration in Austenite: FIG. 17 illustrates the calculation of a frictional work term due to the dislocation forest ($W_f^D$) in the effective stored energy model proposed by Behera. Carbon concentration was measured by XRD experiments, from which the $W_f^D$ term was determined using ThermoCalc software with a para-equilibrium assumption. It shows clearly a linear and negative relation upon temperature, which is expected due to a higher dislocation density at lower temperatures. With the $W_f^D$ term determined by the linear approximation equation depicted in FIG. 17, one can predict the carbon concentration in the austenite phase for the given final partitioning temperature. FIG. 18 exhibits the relationship between the final partitioning temperature and the carbon concentration in the retained austenite phase. It can be seen that the effective stored energy model by Behera predicts the carbon concentration in the retained austenite better than that of the $T_0$ and $T_0$, model proposed by Bhadeshia. Frictional work due to interface movement across forest dislocation ($W_f^D$) does show linear temperature dependence, because of higher dislocation recovery at higher temperatures.

Strength Prediction: The strength is determined by $$\text{Strength}=-0.9246*\text{Temperature}+\text{Solid Solution Strength}+(\text{Hall-Petch Lath Boundary Strength}).$$

Figure 19A:
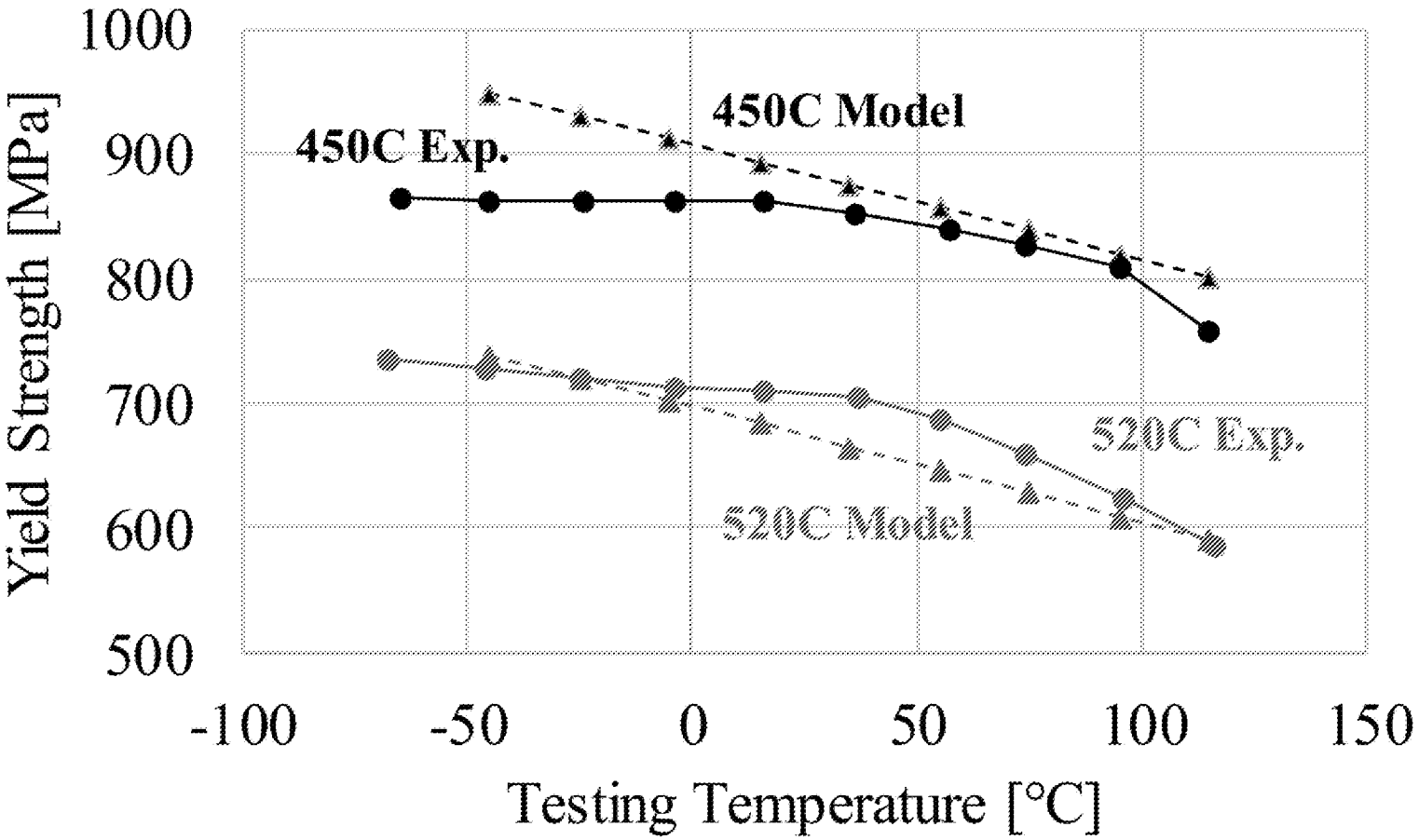
FIGS. 19A-19B show strength prediction for the C&P steel sample, according to embodiments of the invention
Figure 19B:
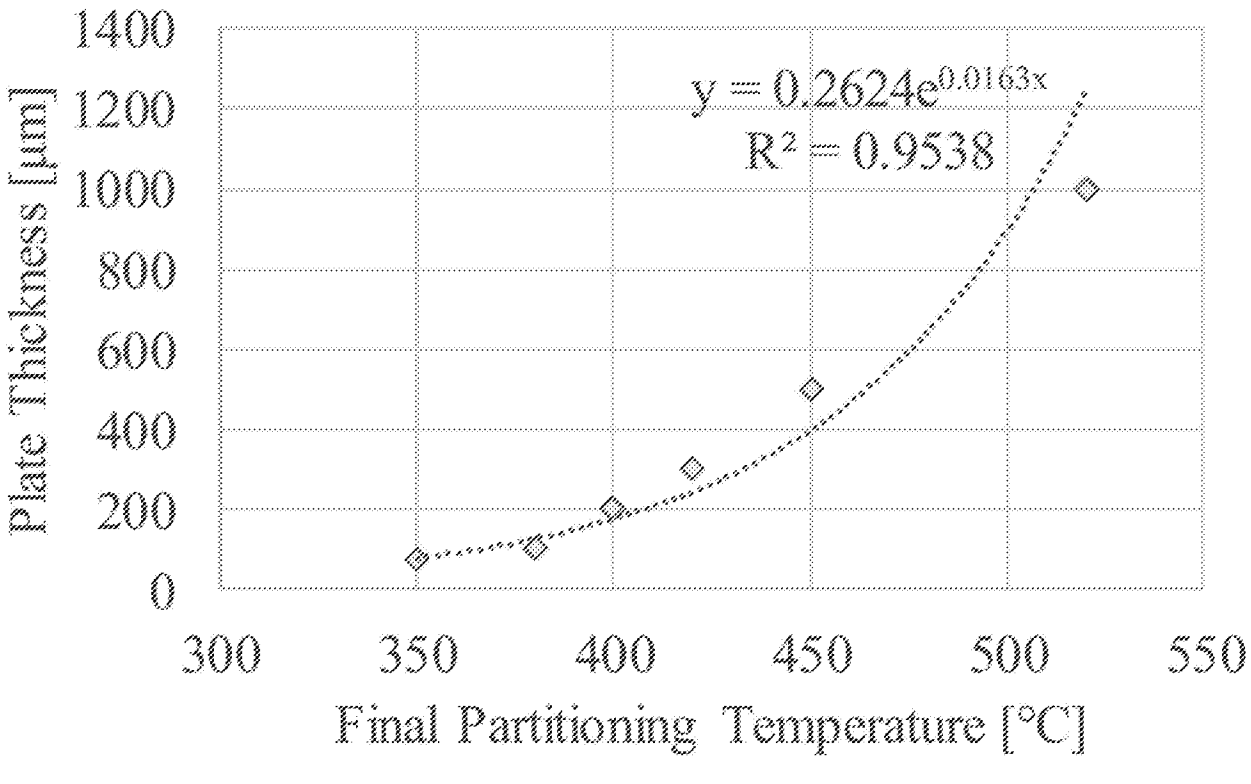

In this exemplary example, the strength model is incorporated with Hall-Petch effect predicts strength well. The strength prediction is shown in FIGS. 19A-19B.

In certain embodiment, the strength model be further sophisticated by incorporating more literature data, including dislocation hardening term, and so on.

Figure 20:
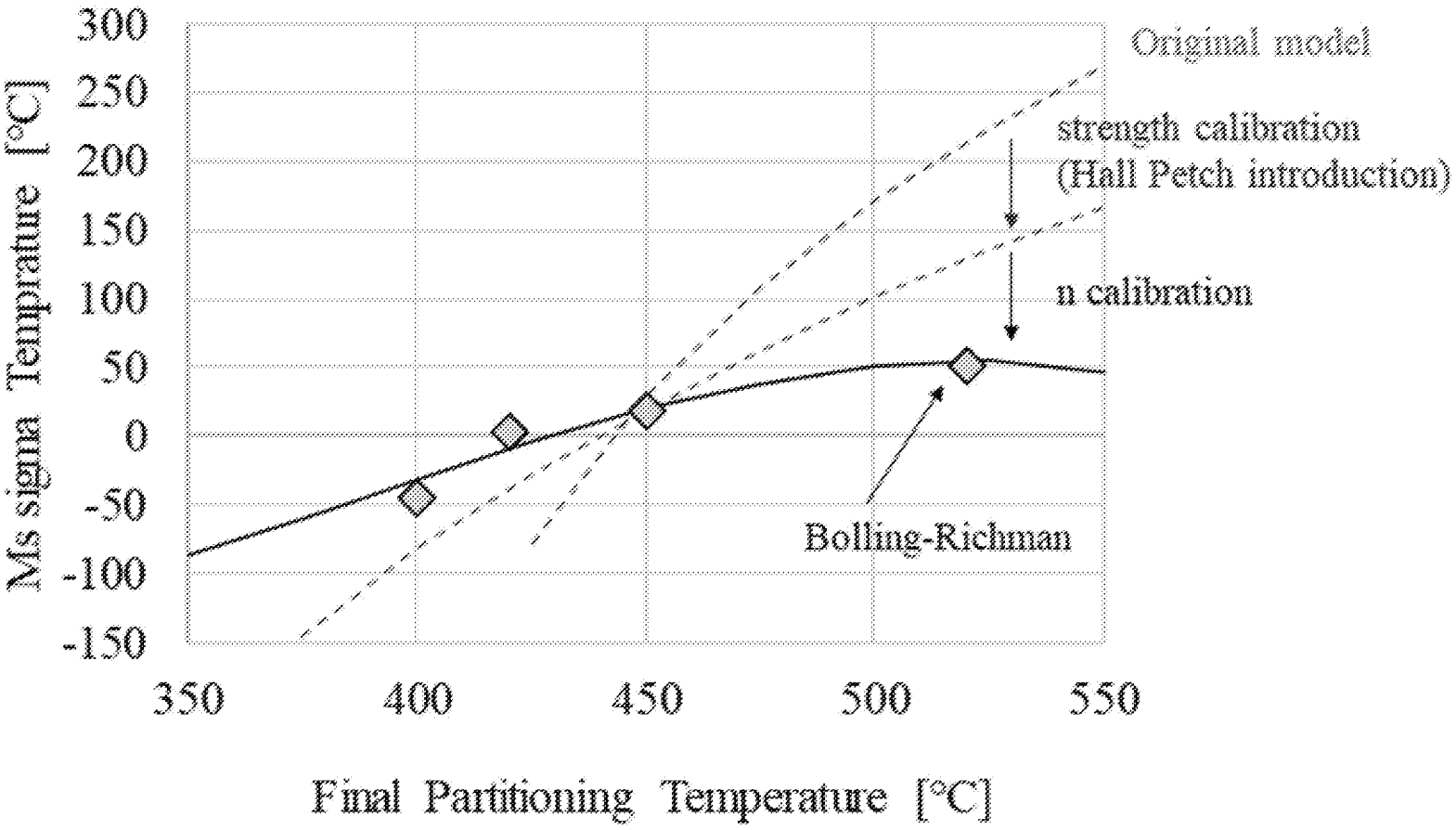
FIG. 20 shows measured and predicted values of $M_s^{\sigma}$ temperature for different final partitioning temperatures. Solid curve shows the prediction from Olson-Cohen $M_s^{\sigma}$ model, whereas points shows experimental data from Bolling-Richman test, according to embodiments of the invention.

Prediction of the $M_s^o$ Temperature: Using the Olson-Cohen $M_s^o$ model described above, the $M_s^o$ temperature was predicted. Due to the dramatic change of lath-thickness depending on the final partitioning temperature. The Hall-Petch effect is newly incorporated into the strength model to calculate the mechanical driving force ($\Delta G_{Mech}$). The carbon concentration model is also incorporated. Predicted $M_s^o$ values were compared to experiments shown in FIG. 20, and then the value of defect potency, n, was calibrated for the predicted values to fit with experiments. FIG. 20 illustrated comparison between measured and calculated $M_s^o$ temperature. After incorporating strength calibration by the Hall-Petch effect and defect potency calibration, predicted values match well with the experiments.

Design Iteration

Figure 21:
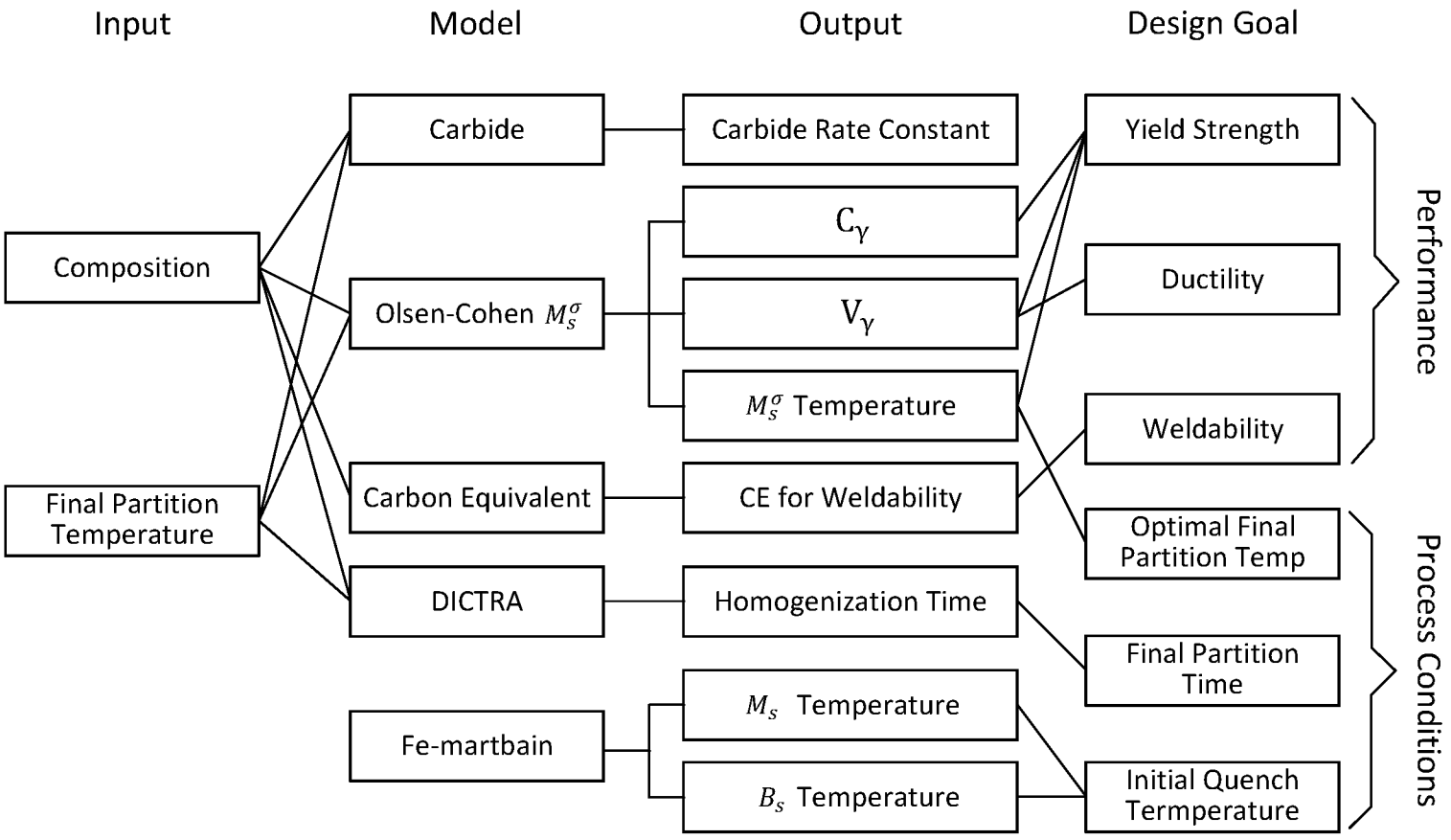
FIG. 21 show schematically a design approach for the carbide-free bainitic TRIP steels for the C&P treatment, according to embodiments of the invention.

With the important modeling tools prepared and calibrated to the experiments with samples from trial design, new design has been determined. FIG. 21 illustrates how the overall design has been performed with the computational models. Three types of new designs with the C&P treatment were proposed for different carbon levels, as listed in Table 4. Besides the Olson-Cohen $M_s^o$ model and fe-martbain model described above, carbide rate constant model, carbon equivalent model and DICTRA software has been utilized to finalize the design.

TABLE 4

Iterated design for CFB TRIP steels for the C&P treatment.

| | Composition | | | | | Property | | Process Conditions | | |
|---|---|---|---|---|---|---|---|---|---|---|
| | C [wt %] | Si [wt %] | Mn [wt %] | Cr [wt %] | Fe [wt %] | Yield Strength [MPa] | $M_s^o$ Temperature [° C.] | Quench Temperature [° C.] | Final Partitioning Temperature [° C.] | Final Partitioning Time [hr] |
| Design 1 | 0.30 | 1.5 | 0.8 | 0.6 | balance | 1280 | 5 | 397 | 300 | 1.9 |
| Design 2 | 0.35 | 1.5 | 0.7 | 0.3 | balance | 1490 | 5 | 390 | 330 | 1.6 |
| Design 3 | 0.40 | 1.5 | 0.4 | 0.3 | balance | 1420 | 5 | 386 | 330 | 1.6 |

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

LIST OF REFERENCES

[1] Roja Modaresi, Stefan Pauliuk, Amund N. LÃyvik, and Daniel B. MÃijller. Global carbon benefits of material substitution in passenger cars until 2050 and the impact on the steel and aluminum industries. *Environmental Science & Technology,* 48(18):10776-10784, 2014. PMID: 25111289.

[2] S. Keeler and M. Kimchi. Advanced high-strength steels application guidlines version 5.0. *WorldAutoSteel,* 2014.

[3] C. M. Tamarelli. The evolving use of advanced high-strength steels for automotive applications. *Steel martket Dev. institute, Autosteel,* 2011.

[4] E. D. Moor D. K. Matlock, J. G. Speer and P. J. Gibbs. Recent developments in advanced high strength sheet steels for automotive applications: an overview. *Jestech,* 15(7):1-12, 2012.

[5] D. Bhandarkar, V. F. Zackay, and E. R. Parker. Stability and mechanical properties of some metastable austenitic steels. *Metallurgical Transactions,* 3(10):2619-2631, October 1972.

[6] Li Wang and John G. Speer. Quenching and partitioning steel heat treatment. *Metallography, Microstructure, and Analysis,* 2(4):268-281, August 2013.

[7] H. K. D. H. Bhadeshia. Nanostructured bainite. *Proceedings of the Royal Society of London A: Mathematical, Physical and Engineering Sciences,* 466(2113):3-18, 2010.

[8] Carlos Garcia-Mateo, Georg Paul, Mahesh C Somani, David A Porter, Lieven Bracke, Andreas Latz, Carlos Garcia De Andres, and Francisca G Caballero. Transferring Nanoscale Bainite Concept to Lower C Contents: A Perspective. *Metals,* 7(159), 2017.

[9] G. B. Olson and M. Cohen. *Dislocation Theory of Martensitic Transformations, volume* 7, pages 295-407. North-Holland, 1986.

[10] G. Ghosh and G. B. Olson. Kinetics of f.c.c. to b.c.c. heterogeneous martensitic nucleation—1. the critical driving force for athermal nucleation. *Acta Metallurgica et Materialia,* 42(10):3361-3370, 1994.

[11] G. Ghosh and G. B. Olson. Kinetics of f.c.c. to b.c.c. heterogeneous martensitic nucleation—2. thermal activation. *Acta Metallurgica et Materialia,* 42(10):3371-3379, 1994.

[12] G. Ghosh and G. B. Olson. Computational thermodynamics and the kinetics of martensitic transformation. *Journal of Phase Equilibria,* 22(3):199-207, 2000.

[13] G. B. Olson, H. K. D. H. Bhadeshia, and M. Cohen. Coupled diffusional/displacive transformations. *Acta Metallurgica,* 37(2):381-390, 1989.

[14] G. B. Olson, H. K D H Bhadeshia, and M. Cohen. Coupled diffusional/displacive transformations: Part II. Solute trapping. *Metallurgical Transactions A,* 21(3):805-809, 1990.

[15] Y. Mizutani. *Coupled gamma/alpha phase transformations in low carbon steels.* PhD thesis, Northwestern University, 2006.

[16] M. J. Aziz. Model for solute redistribution during rapid solidification. *Appl. Phys. Lett.,* 53(1158), 1982.

[17] M. J. Aziz. Dissipation-theory treatment of the transition from diffusionâ€ controlled to diffusionless solidification. *Appl. Phys. Lett.,* 43(552), 1983.

[18] L. M. Goldman and M. J. Aziz. Aperiodic stepwise growth model for the velocity and orientation dependence of solute trapping. *Journal of Materials Research,* 2(4): 524-527, 1987.

[19] V. F. Zackay, E. R. Parker, D. Fahr, and R. Busch. The enhancement of ductility in high strength steels. *Trans. ASM,* 60:252-259, 1967.

[20] G. B. Olson and M. Azrin. Transformation behavior of trip steels. *Metallurgical Transactions A,* 9(5):713-721, May 1978.

[21] E. Pereloma, A. Gazder, and I. Timokhina. Retained austenite: transformation-induced plasticity. *Encyclopedia of Iron, Steel, and Their Alloys, pages* 3088-3103, 2016.

[22] Jiajun Wang and Sybrand Van Der Zwaag. Stabilization mechanisms of retained austenite in transformation-induced plasticity steel. *Metallurgical and Materials Transactions A,* 32(6):1527-1539, June 2001.

[23] R. BlondÃ©, E. Jimenez-Melero, L. Zhao, J. P. Wright, E. BrÃ¼ck, S. Van Der Zwaag, and N. H. Van Dijk. High-energy x-ray diffraction study on the temperature-dependent mechanical stability of retained austenite in low-alloyed trip steels. *Acta Materialia,* 60(2):565-577, 1 2012.

[24] E. Jimenez-Melero, N. H. van Dijk, L. Zhao, J. Sietsma, S. E. Offerman, J. P. Wright, and S. van der Zwaag. Characterization of individual retained austenite grains and their stability in low-alloyed trip steels. *Acta Materialia,* 55(20):6713-6723, 2007.

[25] Xianming Zhao, Yongfeng Shen, Lina Qiu, Yandong Liu, Xin Sun, and Liang Zuo. Effects of intercritical annealing temperature on mechanical properties of fe-7.9mn-0.14si-0.05al-0.07c steel. In *Materials,* 2014.

[26] Koh ichi Sugimoto, Masahiro Misu, Mitsuyuki Kobayashi, and Hidenori Shirasawa. Effects of second phase morphology on retained austenite morphology and tensile properties in a trip-aided dual-phase steel sheet. *ISIJ International,* 33(7):775-782, 1993.

[27] Koh ichi Sugimoto, Akinobu Kanda, Ryo Kikuchi, Shun ichi Hashimoto, Takahiro Kashima, and Shushi Ikeda. Ductility and formability of newly developed high strength low alloy trip-aided sheet steels with annealed martensite matrix. *ISIJ International,* 42(8):910-915, 2002.

[28] S. Zhang and K. O. Findley. Quantitative assessment of the effects of microstructure on the stability of retained austenite in trip steels. *Acta Materialia,* 61(6):1895-1903, 2013.

[29] Trine Nybo Lomholt, Y. Adachi, Alice Bastos da Silva Fanta, Karen Pantleon, and Marcel A. J. Somers. Partial transformation of austenite in al-mn-si trip steel upon tensile straining: an in situ ebsd study. *Materials Science and Technology,* 29(11):1383-1388, 2013.

[30] G. N. Haidemenopoulos and A. N. Vasilakos. On the thermodynamic stability of retained austenite in 4340 steel. *Journal of Alloys and Compounds,* 247(1):128-133, 1997.

[31] Haidemenopoulos Gregory N., Katsamas Antonis I., and Aravas Nikolaos. Stability and constitutive modelling in multiphase trip steels. steel research international, 77(9-10):720-726.

[32] M. L. Brandt. *Bainitic Stabilization of Austenite in Low Alloy Sheet Steels*. PhD thesis, Northwestern University, 1997.

[33] J. Gong. *Predictive Process Optimization for Fracture Ductility in Automotive TRIP Steels*. PhD thesis, Northwestern University, 2013.

[34] A. Behera. *Non-Equilibrium Thermodynamics of Quench and Partition (Q&P) Steels*. PhD thesis, Northwestern University, 2018.

[35] G. B. Olson and Morris Cohen. A general mechanism of martensitic nucleation: Part 1. general concepts and the fcc to hcp transformation. *Metallurgical Transactions A,* 7(12):1897-1904, December 1976.

[36] G. B. Olson and Morris Cohen. Stress-assisted isothermal martensitic transformation: Application to trip steels. *Metallurgical Transactions A,* 13(11):1907-1914, November 1982.

[37] G. B. Olson and Morris Cohen. Kinetics of strain-induced martensitic nucleation. *Metallurgical Transactions A,* 6(4):791, April 1975.

[38] T. Narutani, G. B. Olson, and M. Cohen. Constitutive flow relations for austenitic steels during strain-induced martensitic transformation. In *Journal de Physique (Paris), Colloque*, volume 43, 12 1982.

[39] R. G. Stringfellow, D. M. Parks, and G. B. Olson. A constitutive model for transformation plasticity accompanying strain-induced martensitic transformations in metastable austenitic steels. *Acta Metallurgica et Materialia,* 40(7):1703-1716, 1992.

[40] J. R. Patel and M. Cohen. Criterion for the action of applied stress in the martensitic transformation. *Acta Metallurgica,* 1(5):531-538, 1953.

[41] G. B. Olson, K. Tsuzaki, and Morris Cohen. Statistical aspects of martensitic nucleation. *MRS Proceedings,* 57:129, 1985.

[42] Xinping Chen, Haoming Jiang, Zhenxiang Cui, Changwei Lian, and Chao Lu. Hole expansion characteristics of ultra high strength steels. *Procedia Engineering,* 81:718-723, 2014. 11th International Conference on Technology of Plasticity, ICTP 2014, 19-24 Oct. 2014, Nagoya Congress Center, Nagoya, Japan.

[43] C. S. Smith. *A Search for Structure*. American Association of Physics Teachers, 1981.

[44] G. B. Olson. Computational design of hierarchically structured materials. *Science,* 277(5330):1237-1242, 1997.

[45] Gregory B. Olson. Designing a new material world. *Science,* 288(5468):993-998, 2000.

[46] R. H. Richman and G. F. Bolling. Stress, deformation, and martensitic transformation. *Metallurgical Transactions,* 2(9):2451-2462, September 1971.

[47] C. Garcia-Mateo, F. G. Caballero, and H. K. D. H. Bhadeshia. Development of hard bainite. *ISIJ International,* 43(8):1238-1243, 2003.

[48] Yoshiyuki Tomita, Takeyoshi Okawa, Effect of microstructure on mechanical properties of isothermally bainite-transformed 300M steel, Materials Science and Engineering: A, Volume 172, Issues 1-2, 1993.

[49] John G. Speer et al. Method for producing steel with retained austenite. US 20060011274 A1.

[50] Harshad K D H Bhadeshia et al. Bainite steel and methods of manufacture thereof. U.S. Pat. No. 8,956,470 B2.

[51] RAWSON; Martin J. et al. Alloy and a method of making an alloy. US 20100247368 A1.

[52] F. D. Fischer, G. Reisner, E. Werner, K. Tanaka, G. Cailletaud, T. Antretter, A new view on transformation induced plasticity (TRIP), International Journal of Plasticity, Volume 16, Issues 7-8, 2000.

[53] F. G. Caballero, H. K. D. H. Bhadeshia, K. J. A. Mawella, D. G. Jones & P. Brown, Very strong low temperature bainite, Materials Science and Technology, Volume 18, Issue 3, 2002.

[54] Yuki Toji, Goro Miyamoto, DierkRaabe, Carbon partitioning during quenching and partitioning heat treatment accompanied by carbide precipitation, ActaMaterialia, Volume 86, 2015.

What is claimed is:

1. A carbide-free bainite and retained austenite steel, comprising:

a composition designed and processed such that the carbide-free bainite and retained austenite steel meets property objectives comprising a yield strength in a range of about 1000-2000 MPa, a uniform ductility, a total elongation and hole-expansion ratio, a level of weldability and an austenite stability designed to have an austenite start temperature $M_s^{\circ}$ to be equal to an application temperature in range from about 50° C. to −50° C., wherein the property objectives are design specifications of the carbide-free bainite and retained austenite steel, wherein the composition comprises carbon (C) no more than 0.4 wt. %, silicon (Si) no less than 1.0 wt. %, manganese (Mn) in a range of 0.2-1.0 wt. %, and molybdenum (Mo) of 0.8 wt. %, and iron (Fe) in balance.

2. The carbide-free bainite and retained austenite steel of claim 1, wherein the composition is processed with a cooling and partitioning treatment.

3. The carbide-free bainite and retained austenite steel of claim 1, wherein the property objectives further comprises a carbon concentration in austenite, $C_{\gamma}$, in a range of about 1.0-1.8 wt. %.

4. The carbide-free bainite and retained austenite steel of claim 1, wherein the application temperature is about 5° C., or about −20° C.

* * * * *